US005628076A

United States Patent [19]

Newton

[11] Patent Number: 5,628,076

[45] Date of Patent: May 13, 1997

[54] SELF LOCKING FUTON FRAME

[75] Inventor: John H. Newton, White River Junction, Vt.

[73] Assignee: Nordic Engineering, Inc., White River Junction, Vt.

[21] Appl. No.: 564,909

[22] Filed: Nov. 29, 1995

Related U.S. Application Data

[63] Continuation-in-part of Ser. No. 248,884, May 25, 1994, Pat. No. 5,485,638.

[51] Int. Cl.[6] ..... A47C 17/17

[52] U.S. Cl. ..... 5/37.1; 5/41; 5/42.1; 5/47

[58] Field of Search ..... 5/18.1, 37.1, 38, 5/39, 40, 41, 42, 42.1, 47, 48

[56] References Cited

U.S. PATENT DOCUMENTS

| | | | |
|---|---|---|---|
| 2,319,337 | 5/1943 | McDaniel | 5/47 |
| 2,321,206 | 6/1943 | Holcomb | 5/47 |
| 3,046,571 | 7/1962 | Ducvot | 5/41 |
| 3,175,861 | 3/1965 | Teherniarsky | 297/93 |
| 4,205,405 | 6/1980 | Hagney | 5/44 R |
| 4,217,669 | 8/1980 | Fefferman | 5/47 |
| 4,321,716 | 3/1982 | Shrock | 5/18 R |
| 4,642,823 | 2/1987 | Wiggins | 5/47 |
| 4,737,996 | 4/1988 | Tiffany | 5/37.1 X |
| 4,829,611 | 5/1989 | Shaffield | 5/47 |
| 4,996,730 | 3/1991 | Shaffield | 5/37.1 |
| 5,083,333 | 1/1992 | Newton | 5/37.1 |
| 5,103,510 | 4/1992 | Thurow | 5/37.1 |
| 5,153,951 | 10/1992 | Hester | 5/37.1 |
| 5,153,952 | 10/1992 | Barton et al. | 5/47 |
| 5,345,626 | 9/1994 | Newton | 5/37.1 |
| 5,485,638 | 1/1996 | Newton | 5/37.1 |

*Primary Examiner*—Michael F. Trettel
*Attorney, Agent, or Firm*—Michael J. Weins

[57] ABSTRACT

The present invention is for a futon frame which, in combination with a futon, will serve as a sofa or couch when in the closed position and a bed when in the open position. One embodiment of the futon frame has a base having a pair of base end serpentine slots. A back is provided which has a pair of back pivot pins which slidably engage the base end serpentine slots. A pair of back supports pivotably attach to the back and the base. A seat is pivotably attached to the back and a pair of seat supports pivotably attach to the seat and the base. Preferably, the seat is fitted with supplemental support legs which are automatically concealed within the frame during closing. In a second embodiment an additional pair of back pivot pins are provided which, in combination with an additional pair of base end serpentine slots, replace the back supports.

22 Claims, 19 Drawing Sheets

SELF LOCKING FUTON FRAME

This application is a Continuation In Part of U.S. patent application Ser. No. 08/248,884 filed May 25, 1994, now U.S. Pat. No. 5,485,638.

FIELD OF INVENTION

The present invention relates to a futon frame and more particularity to a self locking and a self adjusting frame which preferably has self storing supplemental support legs.

BACKGROUND OF THE INVENTION

Convertible couch or sofa frames which use pivoting seat and back supports are taught in U.S. Pat. Nos. 3,046,571; 4,321,716; and 5,103,510. However, these frames are for convertible couches and would not serve well as futon frames. The structure of these frames produces translational motion between the seat and the back which will interfere with the folding and extending of the futon. Furthermore, the linkage is complex and results in a complex multi-component frame.

Frames which do not produce translational motion between the seat and back during opening and closing are taught in U.S. Pat. Nos. 5,083,333 and 5,345,626 of the present inventor. However, these patents teach frames which use locking hardware to directly lock the back to the seat member, stabilizing the back with respect to the seat in the closed position and the open position.

Frames which employ simpler linkages are also taught in U.S. Pat. Nos. 3,175,861; 4,205,405; and 4,217,669. While these patents teach simpler linkages, the resulting frame is not well suited to serve as a frame for a free standing conventional couch or sofa. The '861 patent is a convertible chair which can be placed in various positions but does not open to form a bed. Furthermore, the frame of the '861 patent requires locks to stabilize the chair in its alternate seating positions.

The '405 patent teaches a couch which converts to a bed; however, it teaches a frame that is secured to the surface on which it rests. The frame would also not be well suited for supporting a futon since the couch employs a padded back and seat and requires that a spacing pillow be placed between the back pad and the seat pad. These pads would be inconsistent with using the couch to support a futon. Furthermore, the couch is opened with a pull strap which would not be accessible with a futon in place.

The couch of the '669 patent has a frame which is again designed to be attached to the underlying surface on which it rests and without such attachment, the frame would be unstable. Furthermore, the design of the '669 patent leads to a frame constructed from tubular stock which is not well suited for fabrication from wood and does not provide supplemental support legs.

It should also be pointed out that neither the '405 patent nor the '699 patent teaches, discloses or claims couches which have arms as an integral part of their frames.

Futon frames with supplemental support legs attached to the seat of the futon frame provide additional support when the frame is open providing a sleeping surface. Many of these frames have concealable supplemental support legs which can be swung out of sight by the user when the frame is being closed. Typical patents that teach the use of concealable supplemental support legs which are pivotably attached to the seat of a frame are U.S. Pat. Nos. 4,642,823 and 5,083,333. While these patents teach frames with supplemental support legs attached to the seat of the frame, to position the supplemental support legs with respect to these frames requires that the legs be manually positioned by the user. Self positioning supplemental support legs are taught in U.S. Pat. Nos. 4,996,730 and 5,153,951. However, these legs must have a substantial setback from the front edge of the seat (at least the distance of the floor to seat distance) and thus are less effective in stabilizing the frame when in the open position.

Thus, there is a need for a frame which does not require a locking mechanism between the seat and back member which is suitable for use with a futon. There is also a need for an improved leg configuration for a futon frame which converts to a couch where the leg is both self concealing when stored and will provide a high degree of stability when the frame is opened to form a sleeping surface.

OBJECTS OF THE INVENTION

An object of the present invention is to provide a futon frame for a futon which can be easily opened to form a support surface for a futon serving as a bed and closed to support a futon configured to serve as a chair, sofa, or couch.

Another object of the invention is to provide a futon frame which provides supplemental support legs for the seat of the frame to provide additional stability when the futon frame is in its open position.

It is another object of the invention to provide supplemental support legs for the seat when a futon frame is opened which are self concealing when the futon frame is closed.

It is also an object of the invention to provide adjustment mechanisms which will reduce the force needed to open and close a futon frame making it easier to handle stiff futons or queen size futons.

It is another object of the invention to provide a futon frame which will lock in the open and closed positions and does not require latching hardware.

It is yet another object of the invention to provide a futon frame with a pivotably connected seat and back and which has a sliding action associated with opening and closing the futon frame.

It is another object of the invention to provide means for a futon frame to compensate for warpage, misalignment, or twisting due to irregularities in the surface on which the futon frame is supported.

It is still another object of the invention to provide a futon frame with flexibility in the design of the end pieces.

It is yet another object of the invention to provide a frame with greater rigidity in the open or bed position.

It is another object to provide a frame which has few parts.

It is still another object of the invention to provide a futon frame with a reduced base depth.

These and other objects of the invention will be apparent from the following description drawings and claims.

SUMMARY OF THE INVENTION

One simple embodiment of the present invention provides a futon frame which has a base having a first base end with a first base end slot and a second base end with a second base end slot.

A back is provided which is bounded by a first back side member, a top cross member, a second back side member, and a bottom cross member. A seat is pivotably attached to the back. The seat is bounded by a first seat side member, a front cross member, a second seat side member, and a rear cross member. It is preferred that the seat be connected to the back by pivotably engaging the back side members and seat side members.

The back has a first back pivot pin which attaches to the first back side member and a second back pivot pin which attaches to the second back side member. The first back pivot pin slidably engages the first base end slot and the second back pivot pin slidably engages the second base end slot. It is further preferred that, interposed between the back pivot pins and the base end slots, there are movable bearing surfaces such as sliders or rollers which engage the back pivot pins and reside in the base end slots.

A first back support is pivotably attached to the first back side member and to the base. A second back support is pivotably attached to the second back side member and to the base.

The connection between the back supports and the base is preferably indirect either by having spacers interposed between the back supports and the base ends onto which the spacers are mounted or alternatively, by employing hinges mounted to a base aft cross member which, in turn, is attached to the first base end and the second base end; the back supports can be pivotably mounted thereto.

A first seat support is pivotably attached to the first seat side member and to the base and preferably to the first base end. A second seat support is pivotably attached to the second seat side member and to the base and preferably to the second base end.

It is further preferred, to facilitate the opening and closing of the futon frame, that the first back support and the second back support pivot about a first pivot axis A which is fixed with respect to the base and about a second pivot axis B which is fixed with respect to the back.

The first back pivot pin and the second back pivot pin lie on a third axis C which moves in the surface generated by the first base end slot and the second base end slot.

To reduce the relative motion between the futon and the back and seat on which the futon is resting when the frame is opened and closed, it is further preferred that the first back side member and the second back side member pivotably engage the first seat side member and the second seat side member about a fourth axis D which is fixed with respect to both the back and the seat.

It is also preferred that the first seat support and the second seat support pivot about a fifth pivot axis E which is fixed with respect to the seat and about a sixth axis F which is parallel to the axis E and fixed with respect to the base. Having the pivotal action be about the axes as described above facilitates the cooperative movement among the various elements of the frame and minimizes the motion among the seat, the back and the futon placed thereon.

To further increase the stability of the frame in the open position, it is preferred that a first supplemental support leg be pivotably attached to the first seat side member and a second supplemental support leg be pivotably attached to the second seat side member.

It is still further preferred that the base have a base forward cross member which lies forward of the base aft cross member and that the supplemental support legs have base forward cross member engaging surfaces which slidably engage the base forward cross member when the frame is being opened and closed. The supplemental support legs pivot about pivot points which are forward of the base forward cross member when the seat is in the closed position. The supplemental support legs are positioned such that they will clear the base forward cross member during the initial portion of the closing process and the forward surfaces of the legs will engage the front cross members during the latter stage of the closing process assuring that the legs reside within the base when the futon frame is in its closed position.

Since the weight of the futon is substantial, and since thick futons have limited flexibility, it is further preferred that the ratios of the distances between selected pivot axes be maintained within specified limits to reduce the effort required to open and close the frame and that the relative placement of the pivot axes be so positioned to assure the frame will not open and close accidentally.

Maintaining the axes B, C, D, E, and F co-planar when the futon frame is open serves to lock the futon frame in the open position and will maintain the back and seat in a planar configuration. Any pivoting motion between the back and the seat will be resisted since the seat supports will, under this condition, be axially loaded and thus, not be free to move. In order to move the back relative to the seat, it is necessary to first raise the seat. Similarly, when the futon frame is in a closed position and the axes D, E, and F are co-planar, the back cannot move forward or backward unless the seat is raised since the seat supports are axially loaded.

To facilitate opening, it has been found that when BC and CD are about equal, the back closes more easily. It has been also found that lengthening the separation of these axes facilitates closing. However, there is a practical limit of about ten (10) inches to the length CD since longer lengths will excessively lower the seat. Furthermore, it is preferred that AB be greater than BC so that B, C, D, E, and F will be co-planar when the frame is opened. It has also been found that maintaining BD about equal to DE is preferred since as one increases the length DE, the angle between the seat and the back decreases less as the frame closes. However, if DE becomes too long, the seat becomes too deep for one to comfortably sit since the seat will exceed the hip to knee distance.

To further reduce the effort in opening and closing the futon frame, which becomes particularly difficult when the futon is thick and therefore inflexible, it is preferred that means for altering the kinematics of the seat and back movement be provided. One preferred mechanism for altering the kinematics of opening and closing is to provide a small component of motion of the F axis in the plane defined by the axes E and F. Such can be provided by a slot and spring combination.

Alternatively, it has been found that means for altering the kinematics of opening and closing can be provided by employing a serpentine path for the base end slots to facilitate the opening and closing of the frame. When a serpentine path is employed, it is further preferred that the path over which the rollers track be composed of three segments, a rear segment, a middle segment, and a forward segment. The rear segment is about one fourth of the path traversed and has a slight grade gradually rising. The middle segment is about one half of the length of the path, has a shallow grade and gently falls. The forward segment again rises and brings the seat into the plane formed by the axes B, E, and F. It is further preferred that the grade of the middle segment be less than about 15°. It is further preferred that the rise of the forward segment be about twice the rise of the rear segment. Having a serpentine path such as described above causes the seat to rise faster on closing assuring the legs move further back before lowering. This further rearward movement assures that the legs will be positioned substantially behind the base forward cross member on closing.

In another simple embodiment, it has been found that the back supports can be eliminated while still maintaining the benefits of the ease of opening, the self locking character, as well as providing a hardware free frame. This embodiment also allows the depth (front to back dimension) of the couch to be reduced.

For this embodiment, the frame has a base with a first base end and a second base end. The first base end has a first base end lower serpentine slot and a first base end upper serpentine slot residing therein. The first base end lower serpentine slot has a first lower slot forward end. The first base end upper serpentine slot has a first horizontal upper slot forward section which is aligned with the first lower slot forward end.

Similarly the second base end has a second base end lower serpentine slot and a second base end upper serpentine slot residing therein. The second base end lower serpentine slot has a second lower slot forward end. The second base end upper serpentine slot has a second horizontal upper slot forward section which is aligned with the second lower slot forward end.

It is further preferred that the first base end lower serpentine slot be provided with a first horizontal lower slot forward section which terminates in the first lower slot forward end and that the second base end lower serpentine slot be similarly provided with a second horizontal lower slot forward section which terminates in the second lower slot forward end. Having base end upper and lower serpentine slots with horizontal forward sections assists in stabilizing the frame when it is in the open position.

A back is provided having a first back side member and a second back side member. A lower first back pivot pin and a upper first back pivot pin are attached to the first back side member and respectively engage the first base end lower serpentine slot and the first base end upper serpentine slot. A lower second back pivot pin and a upper second back pivot pin are attached to the second back side member and respectively engage the second base end lower serpentine slot and the second base end upper serpentine slot. Greater rigidity of the back when the futon frame is in the closed position can be obtained by increasing the separation between the lower back pivot pins and the upper back pivot pins. At large separations, the base end upper serpentine slots will require a substantially vertical component to provide for the raising of the upper back pivot pins as the back is raised.

A seat which has a first seat side member and a second seat side member is pivotably connected to the back. A first seat support is pivotably connected to the first seat side member and to the base while a second seat support is pivotably connected to the second seat side member and to the base.

Embodiments with base end upper and lower serpentine slots which eliminate the back supports employed in the earlier described embodiment require one less axis of rotation. The axes required in the notation used above for the embodiments with back supports, are the axes B, C, D, E, and F.

As the length of the separation between axis F and axis E (which corresponds to the throw of the seat supports) increases, the separation between axis E and axis D (the spacing between the pivotal point of the seat supports with respect to the seat and the pivotal point between the seat and back) is preferably increased by an equivalent amount. This will preserve centering of the seat and back with respect to the base when the futon frame is opened and avoid shifting of the axis D.

It has also been found that reducing the spacing between axis D and axis C relative to the spacing between axis C and axis B allows a reduction in the rise needed of the serpentine paths for the initial stages of opening and final stages of closing. This reduces the force needed during the final stages of closing and provides a faster rise during the final stages of opening.

A steeper grade near the final open position provides a retarding force to reduce the fall of the back as the futon frame is opened but increases the force needed to start the raising of the seat from the open position to the closed position.

While the above configuration has several benefits it places some additional limitations on the design of the futon frame. Either the upper and lower back pivot pins must be in close proximity to the seat which may reduce the rigidity of the back when the futon frame is in the closed position and make the alignment of the axes B and C more critical, or the styling of the futon frame must have large solid panels of substantial height to accommodate the base end upper serpentine slots. It is also necessary to provide free space behind the futon frame to accommodate the outward motion of the back as the back is lowered.

While the backward motion requires greater separation of the futon frame from the wall during opening, it brings a benefit in that a larger minimum angle is maintained between the seat and the back as the futon frame is opened thereby reducing the resistance resulting from folding of the futon.

It has also been found that the slots having a serpentine path with a rear segment with a slight grade, a middle segment with a steep grade, and a forward segment which is substantially horizontal has benefits when used with frames which employ seat supports and back supports in that it moves the back pivot pins in closer proximity to the pivot point for the seat. Having the seat pivot point so located, in combination with having a substantially horizontal forward segment of the serpentine path, provides greater rigidity of the seat when the frame is in the open position since the back pivot pins are restrained in the serpentine slots and their proximity to the seat pivot point will reduce the vertical motion of the seat.

While a serpentine path having a middle segment with a steep slope is adequate for full size beds it can result in large forces for frames which are designed to carry stiff queen size futons. For queen size futons, it is preferred to have a base which has a first base end serpentine slot and a second base end serpentine slot which have more gradual rise and fall. However, to effect such a path change requires a decrease in the separation of the axes B and C described above. This change in the separation between the B axis and the C axis results in an increase in the separation between the C axis and the D axis which in turn reduces the rigidity of the back and the seat in the open position.

It is preferred that means for increasing the rigidity of the back and seat be provided. Any of a variety of stabilizers such as blocks or rollers attached to the base which engage the back when the frame is open can be employed. These stabilizers are used in combination with a means for engaging the stabilizers with the back when the futon frame is in the open position.

One preferred means for engaging the stabilizers with the back is a means for varying the separation between the A axis and the B axis and retaining a smaller separation until such time as the back has swung past the stabilizers.

One simple way of providing a variable separation is to pivotably connect one end of the back supports to the back with back support pins which engage cylindrical holes in the back supports and to connect the base to the other end of the back supports with base support pins which engage back support slots in the back supports.

BRIEF DESCRIPTION OF THE FIGURES

As illustrated in FIG. 27, the spring is at its position of minimum strain.

BEST MODE OF CARRYING THE INVENTION INTO PRACTICE

Figure 1:
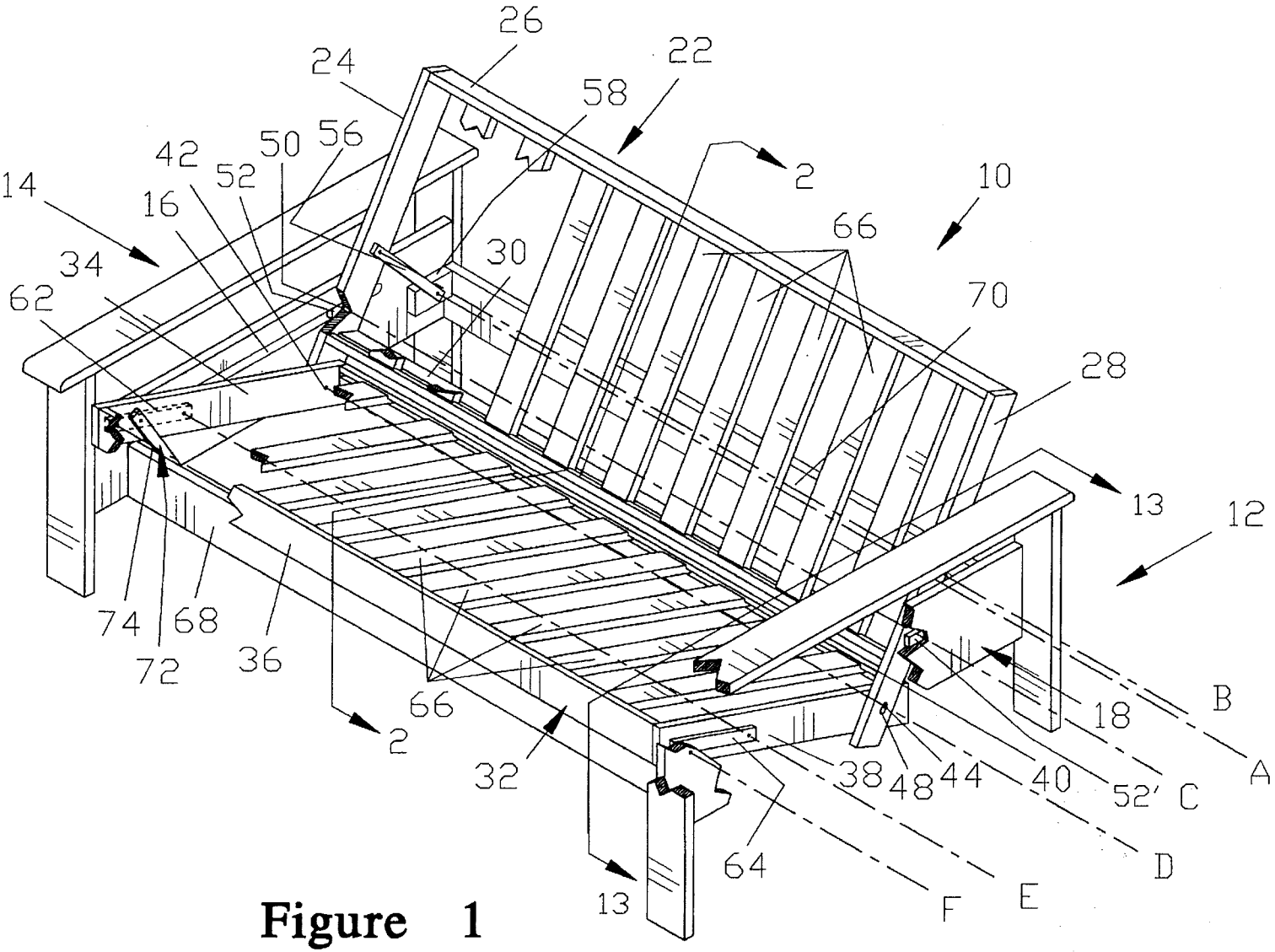
FIG. 1 is an isometric view of one embodiment of the present invention for a futon frame. The futon frame is shown in its closed position where the futon frame, in combination with a futon (not shown) serves as a couch or sofa. The futon frame has a base, a seat, and a back. The futon frame employs a first seat support and a second seat support which are pivotably mounted to the seat and the base. The futon frame also employs a first back support and a second back support which are pivotably attached to the back and to spacers which, in turn, are attached to the base. The seat and back have side members and cross members which form the peripheral elements, bounding the seat and the back. Slats mounted in the cross members provide support surfaces for the futon. The cross members are raised with respect to the slats and serve to limit the slippage between the seat and the back and the futon resting thereon.
Figure 2:
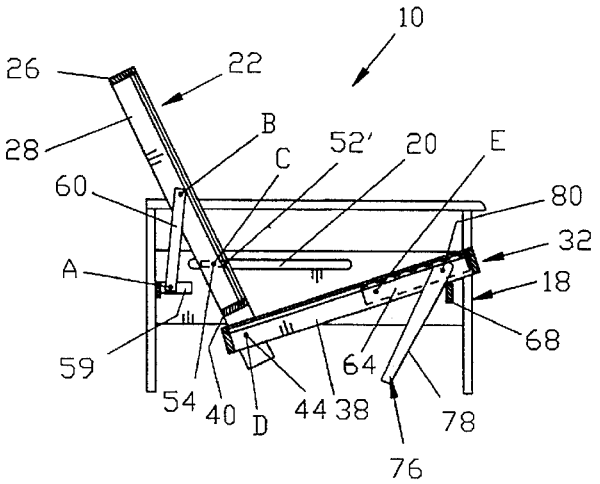
FIG. 2 is a section 2—2 of FIG. 1 illustrating the futon frame in the closed position where the futon frame, in combination with a futon, serves as a couch or sofa.

FIG. 1 is an isometric view of one embodiment of the present invention. A futon frame 10 is illustrated in the closed position. When the futon frame 10 is used in combination with a futon (not shown), it forms a couch or sofa. In the open position, the futon frame 10, in combination with a futon, forms a bed. FIG. 2 is a cross section 2—2 of FIG. 1 and will be used in combination with FIG. 1 to describe the embodiment of FIG. 1.

The futon frame 10 has a base 12 which has a first base end 14 having a first base end slot 16 and a second base end 18 having a second base end slot 20 (shown in FIG. 2). A back 22 is provided which is bounded by a first back side member 24, a top cross member 26, a second back side member 28, and a bottom cross member 30.

A seat 32 is provided which is bounded by a first seat side member 34, a front cross member 36, a second seat side member 38, and a rear cross member 40. The seat 32 is pivotably attached to the back 22. A first seat pivot pin 42 is attached to the first seat side member 34 and a second seat pivot pin 44 is attached to the second seat side member 38. While the present embodiment illustrates the seat pivot pins (42 and 44) as being attached to the seat side members (34 and 38), they could equally well be mounted to the back side members (24 and 28).

Figure 11:
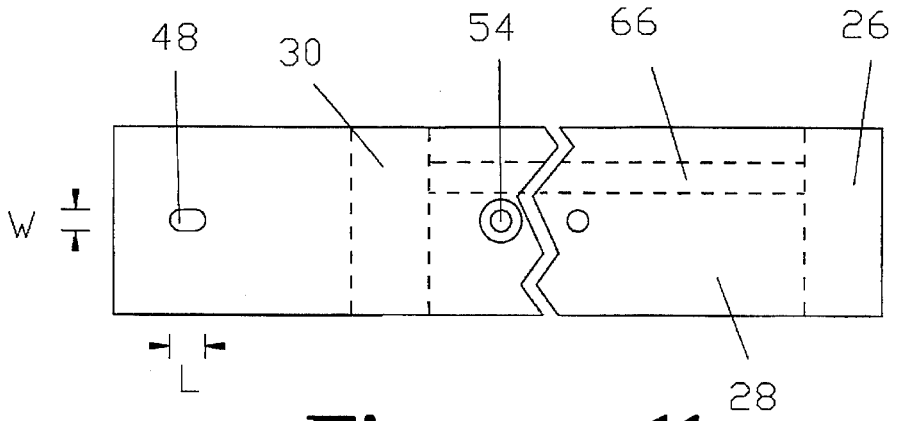
FIG. 11 is a side view of the back side member of FIG. 1.

The first seat pivot pin 42 passes through a first passage 46 (not shown) in the first back side member 24. The second seat pivot pin 44 passes through a second passage 48 in the second back side member 28. It should be appreciated that the seat pivot pins (42 and 44) could equally well be attached to the back 22 and pass through passages in the seat 32. These seat pivot pins (42, 44) and corresponding passages (46, 48) serve to pivotably connect the back 22 to the seat 32. FIG. 11 illustrates an enlarged view of the second back side member 28 of the futon frame 10 and illustrates the preferred geometry slots which serve as passages (46, 48) through which the seat pivot pins (42, 44) pass. The preferred geometry for the second passage 48 is a slot which has a width w slightly greater than a diameter d of the second seat pivot pin 44 (not shown) and a length L about twice that of the width. This oblong passage 48 provides flexibility in the connection to accommodate minor adjustments needed for warping and misalignment of the frame elements.

The back 22 has a first back pivot pin 50 attached to the first back side member 24 which pivotably and slidably engages the first base end slot 16. In this embodiment, a slider 52 is interposed between the first back pivot pin 50 and the first base end slot 16. The back 22 has a second back pivot pin 54 (shown in FIG. 2) attached to the second back side member 28 which pivotably and slidably engages the second base end slot 20 (shown in FIG. 2). In this embodiment, a slider 52' is interposed between the second back pivot pin 54 and the second base end slot 20.

Figure 9:
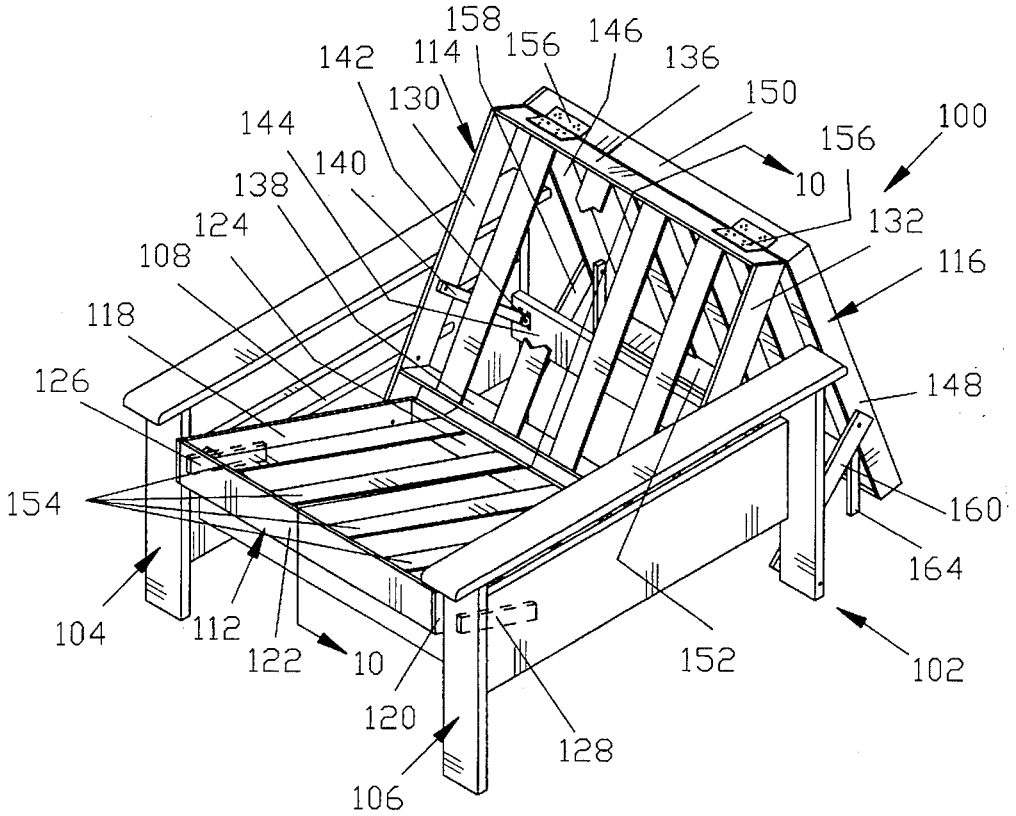
FIG. 9 is an isometric view of another embodiment of the present invention for a futon frame which, when used in combination with a futon, provides a chair in the closed position (shown) and a bed when in the open position.
Figure 10:
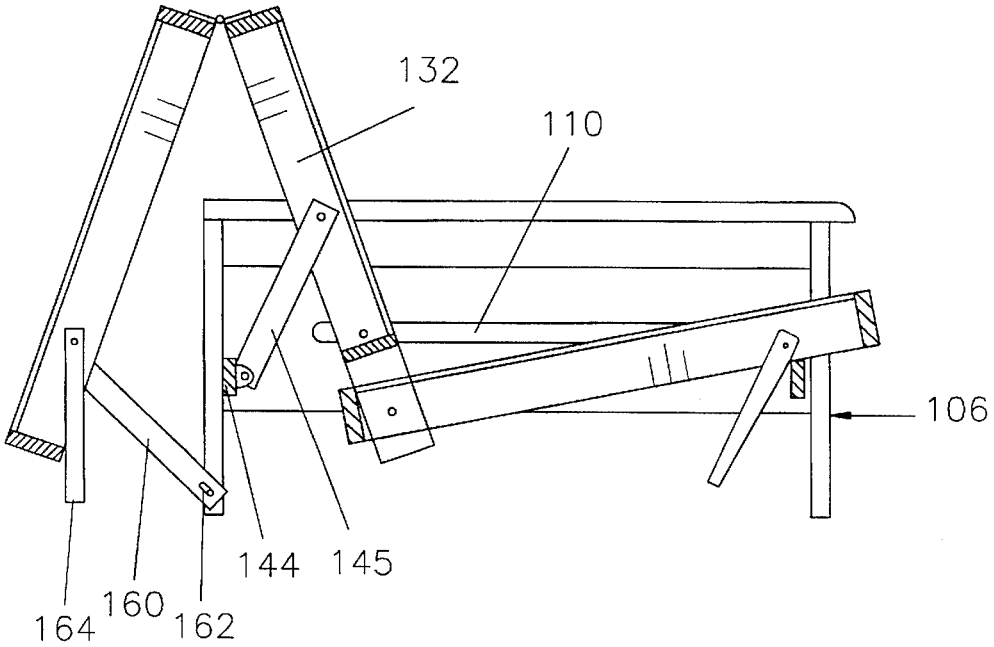
FIG. 10 is a cross section 10—10 of FIG. 9 and illustrates the use of a slot to provide adjustment resulting from misalignment of the elements.

A first back support 56 pivotably attaches to the first back side member 24 and to the base 12. In this embodiment, the pivotable attachment to the base 12 is to the first base end 14 which is fitted with a first spacer 58. Similarly, a second back support 60 (best illustrated in FIG. 2) pivotably attaches to the second back side member 28 and to the second base end 18. Again, the connection is to the second base end 18 and a second spacer 59 is interposed between the second back support 60 and the second base end 18o An alternate attachment of the back supports to the futon frame 10 is illustrated in FIGS. 9 and 10 and will be discussed later.

A first seat support 62 (hidden in FIG. 1 by the first seat side member 34) pivotably attaches to the first seat side member 34 and to the first base end 14 of the base 12. A second seat support 64 pivotably attaches to the second seat side member 38 and to the second base end 18.

Slats 66 are provided for the seat 32 and the back 22 which serve to support the futon. The slats 66 for the back 22 attach the top cross member 26 of the back 22 and the bottom cross member 30 of the back 22. To enhance the gripping of the futon by the futon frame 10, it is preferred that the top cross member 26 and the bottom cross member 30 be raised with respect to the slats 66. Similarly, the slats 66 for the seat 32 attach to the front cross member 36 and the rear cross member 40 of the seat 32. Again, for the reason discussed above, it is preferred that the front cross member 36 and the rear cross member 40 be raised with respect to the slats 66.

The base 12 has a base forward cross member 68 and a base aft cross member 70, both of which connect to the first base end 14 and the second base end 18 and serve to further stabilize the base 12. The base forward cross member 68 also provides partial support for the seat 32 when the futon frame 10 is in its open position and in its closed position. Similarly, the aft cross member 70 provides partial support to the back 22 when the futon frame 10 is in its open position.

To stabilize the futon frame 10 when it is in the open position, supplemental support legs (72, 76) are provided. The first supplemental support leg 72, having a first base forward cross member engaging surface 74, is pivotably attached to the first seat side member 34 forward of the base forward cross member 68 and in close proximity to the front cross member 36 of the seat 32 as is illustrated in FIG. 1. The second supplemental support leg 76 (shown in FIG. 2), having a second base forward cross member engaging surface 78, is pivotably attached to the second seat side member 38. Since the supplemental support legs (72 and 76) pivot toward the base aft cross member 70 on closing, pivot points 80 for the supplemental support legs (72, 76) should be placed so as to remain forward of the base forward cross member 68 during the latter stages of closing and in close proximity to the front cross member 36 of the seat 32. Such is not possible for the pivotable support legs of the '730 and '951 patents. The supplemental support legs (72, 76) are positioned such that the first and second base forward cross member engaging surfaces (74, 78) engage the base forward cross member 68 and direct the first supplemental support leg 72 and the second supplemental support leg 76 to a position concealed by and stored behind the base forward cross member 68 of the futon frame 10, as shown in FIG. 1.

Figure 4:
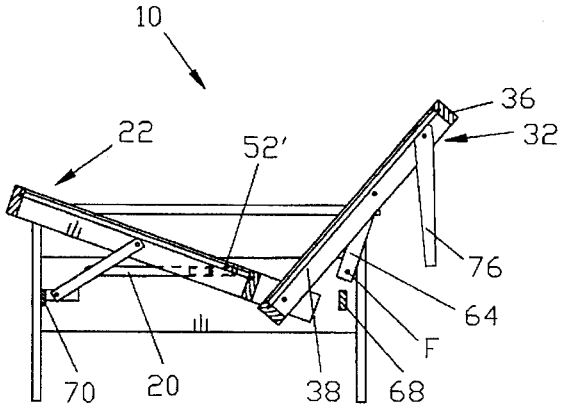
FIG. 4 is an illustration of the cross section of FIGS. 2 and 3 wherein the frame is partially open and has moved further toward the open position.
Figure 3:
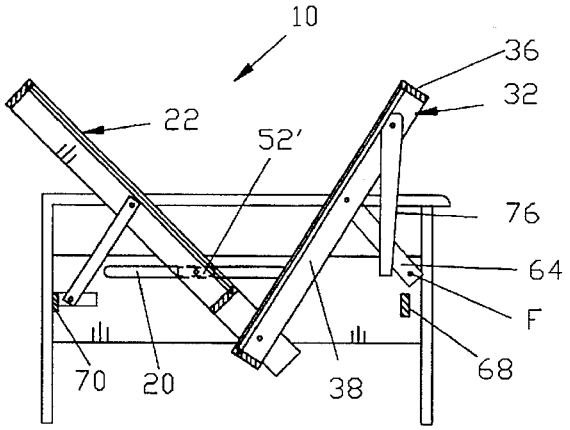
FIG. 3 is an illustration of the cross section of FIG. 2 in an intermediate position between the closed position and the open position.

FIG. 3 illustrates the futon frame 10 where the front cross member 36 has been raised and the seat 32 has moved forward to a position where it would be at an early stage of the opening of the futon frame 10. In the position illustrated in FIG. 3, the supplemental support legs (72, 76) have passed over the base forward cross member 68 and will lower in front of the base forward cross member 68 as the futon frame 10 is opened. FIG. 4 illustrates the futon frame 10 as the seat 32 is in a further stage of the opening process.

Figure 5:
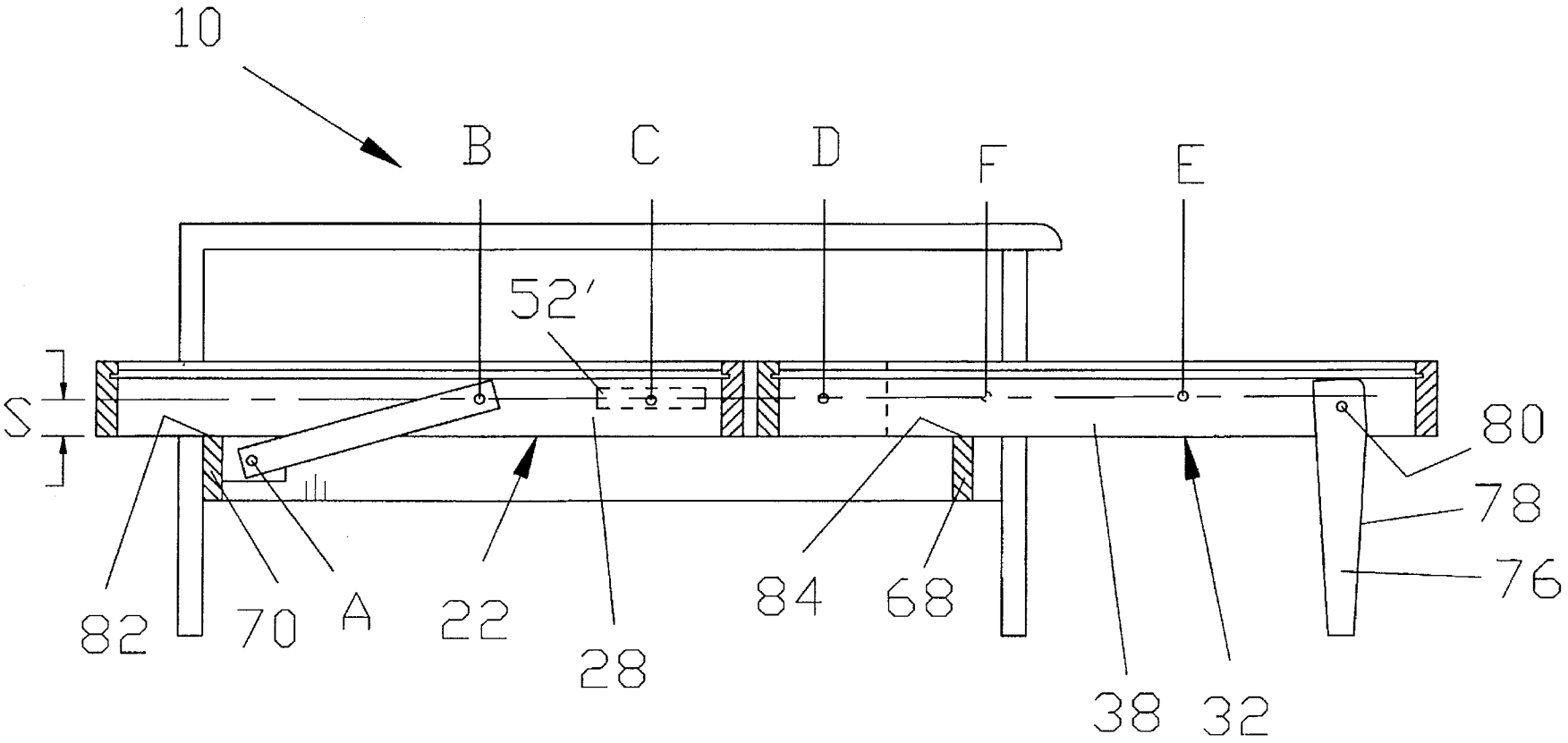
FIG. 5 is an illustration of the cross section of FIGS. 2 through 4 where the futon frame is in the open position. In the open position, the futon frame, in combination with a futon, will serve as a bed.

FIG. 5 illustrates the futon frame 10 in the open position where the back 22 and the seat 32 are co-planar and serve as a surface on which an extended futon will rest and, in combination with the futon frame 10, form a bed. In this position the supplemental support legs (72, 76) provide additional support to avoid tipping of the futon frame 10 when weight is applied to the forward portion of the seat 32.

As can be seen from reviewing FIGS. 2 through 5, the futon frame 10 moves from a closed position where, with a futon resting thereon, the futon frame 10 will serve as a couch or sofa to an open position where, with a futon resting thereon, the futon frame 10 will serve as a bed. This motion is obtained with minimal translational motion between the seat 32 and back 22 with respect to a futon resting thereon since the seat 32 and the back 22 are pivotably attached.

Referring principally to FIG. 2 in combination with FIG. 1, during opening and closing of the futon frame 10, the first back support 56 and the second back support 60 pivot about a first axis A which is fixed with respect to the base 12 and simultaneously pivot about a second parallel pivot axis B which is fixed with respect to the back 22.

The back pivot pins (50, 54) lie on a third common axis C and this axis is parallel to the axes A and B (as shown in FIG. 1) and moves across the plane defined by the first base end slot 16 and the second base end slot 20, illustrated with the second base end slot 20 shown in FIG. 2. Having the third axis C so defined and maintaining the parallel relationship between the axes A and B assures that the motion of these axes will provide cooperative movement between the elements so connected.

A fourth axis D, which is fixed with respect to both the seat 32 and the back 22, further promotes the cooperative action between the various connected elements and assures that only rotational motion will occur between the seat 32 and the back 22. The seat pivot pins (42, 44) lie on the fourth common axis D, which is parallel to the axes B and C.

The first seat support 62 and the second seat support 64 pivot about a fifth pivot axis E which is fixed with respect to the seat 32 and a sixth axis F (shown in FIGS. 3 and 4) which is fixed with respect to the base 12. Again, the fifth axis E and the sixth axis F are parallel to the axes A, B, C and D.

The axes B, C, D, E and F are also so positioned that, when the futon frame 10 is open and the back 22 is in contact with the base aft cross member 70 and the seat 32 is in contact with the base forward cross member 68, the axes B, C, D, E and F are co-planar as is illustrated in FIG. 5. The base aft cross member 70 has a contact surface 82 and the base forward cross member 68 has a contact surface 84. To maintain co-planar alignment of the axes, it is necessary for the contact surfaces (82, 84) of the base aft cross member 70 and the base forward cross member 68 to be planar and the separation from that plane to the plane of the co-planar axes B, C, D, E and F must be a distance S.

The kinematics of opening and closing as described above operate most favorably when BC and CD are about equal since the back 22 closes easier. (See FIGS. 2 and 5.) It has been also found that lengthening the separation of these axes facilitates closing. However, there is a practical limit of about ten (10) inches to the length of CD, since longer lengths will excessively lower the seat 32. Furthermore, it is preferred that AB be greater than BC so that B,C,D,E, and F will be co-planar when the futon frame 10 is opened. It has also been found that maintaining BD about equal to DE is preferred since as one increases the length DE, the angle between the seat 32 and the back 22 decreases less as the futon frame 10 closes. However, if DE becomes too long, the seat 32 becomes too deep for one to comfortably sit, since the seat 32 will exceed the hip to knee distance.

Figure 6:
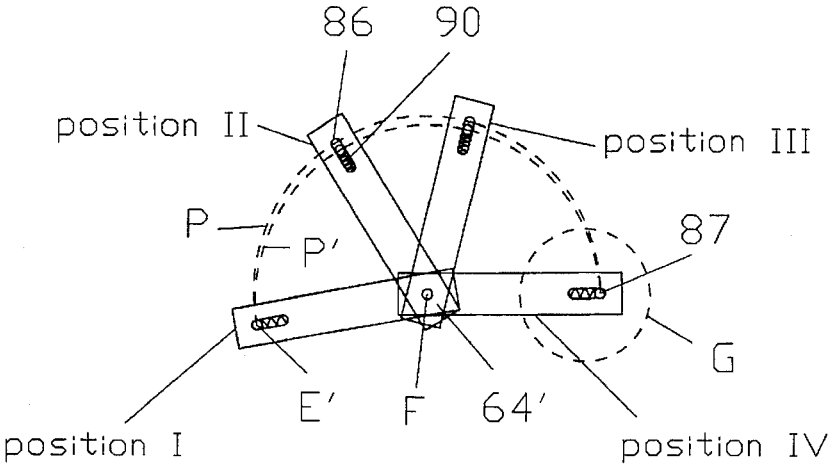
FIG. 6 is a schematic representation of a seat support which provides means for altering the kinematics of opening and closing a futon frame. The seat support is shown in multiple positions including the positions it assumes when the frame is closed and when it is open.

In situations where the futon is either very heavy or its thickness is such that the futon is stiff and difficult to fold, it is further preferred that other means for altering the kinematics of opening and closing be provided. FIG. 6 illustrates a modified seat support configuration 64' which can be substituted for the seat supports (62, 64) and used in combination with the futon frame 10 shown in FIG. 1. The seat support 64' reduces the force needed to open and close the futon frame 10. FIG. 6 illustrates the seat support 64' in four positions. The first position I is associated with the closed position of the futon frame 10 shown in FIG. 2. The second position II is associated with the partially open position shown in FIG. 3. The third position III is the position associated with the partially open position of FIG. 4 and the fourth position IV is the position associated with the fully opened futon frame 10 of FIG. 5. The seat support 64' pivots about the axis F of the futon frame 10. However, in this embodiment, rather than pivoting about the axis E at a fixed distance with respect to the axis F, the seat 32 pivots about an axis E' with respect to the axis F, providing a translational motion. A slot 86 is provided in the seat support 64' through which a seat support pivot pin 87 passes. The slot 86 changes the traverse of the axis E from a circular path P to a lower path P', reducing the work associated with raising the seat 32 thus, making the futon frame 10 easier to open and close.

Figure 7:
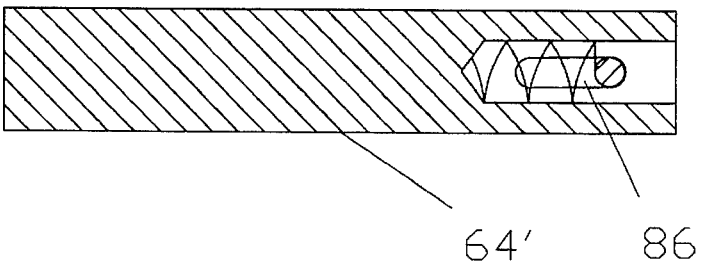
FIG. 7 is an enlarged elevation view of the encircled region of FIG. 6.
Figure 8:
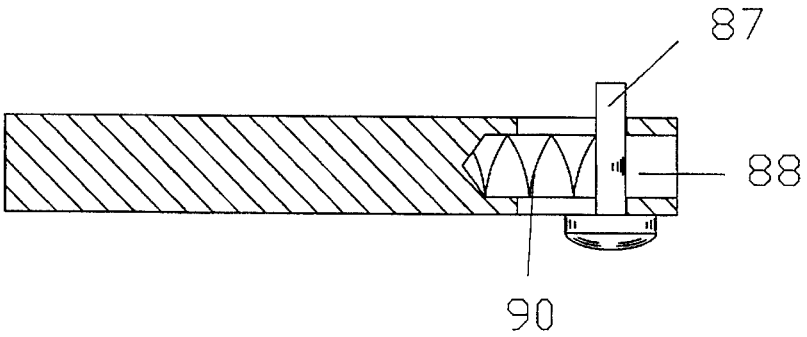
FIG. 8 is an enlarged top view of the encircled region of FIG. 6.

FIGS. 7 and 8 are, respectively, a top view and an elevation view of region G of FIG. 6, further illustrating the slot 86 of the seat support 64'. A cylindrical hole 88 is provided in the seat support 64' which parallels the slot 86 for holding a spring 90. The spring 90 biases the seat support pivot pin 87 which serves as the rotational axis of the seat support 64' with respect to the seat 32. The spring 90 allows the seat 32 to translate relative to the seat support 64'.

FIG. 9 is another embodiment of the present invention. This embodiment is for a futon frame 100 which forms a tri-fold futon frame which, in combination with a futon, converts from a chair, as shown in FIG. 9, to a bed. The futon frame 100 has a base 102 which has a first base end 104 and a second base end 106. The first base end 104 has a first base end slot 108 and the second base end 106 has a second base end slot 110 as shown in FIG. 10. A seat 112 is pivotably connected to a back 114 which in turn is pivotably connected to a rear deck 116.

The seat 112 has a first seat side member 118 and a second seat side member 120. These seat side members (118, 120), in combination with a front cross member 122 and a rear cross member 124, form the periphery of the seat 112. A first seat support 126 shown behind the first seat side member 118, pivotably attaches to the first seat side member 118 and the first base end 104. A second seat support 128 pivotably attaches to the second seat side member 120 and the second base end 106.

The back 114 has a first back side member 130 and a second back side member 132. A back top cross member 136 and a back bottom cross member 138 complete the periphery of the back 114. A first back support 140 is pivotably attached to the base 102 and the first back side member 130. The attachment to the base 102 is by a hinge 142 which in turn is connected to a base aft cross member 144. A second back support 145 (shown in FIG. 10) is provided which is pivotably attached to the base 102 and to the second back side member 132 in an analogous manner as the first back support 140.

The rear deck 116 has a first rear deck side member 146 and a second rear deck side member 148 which, in combination with a back cross member 150 and a free end cross member 152, form the periphery of the rear deck 116.

The seat 112, the back 114, and the rear deck 116 have slats 154 which connect the cross members of the seat 112, the back 114, and the rear deck 116 forming a support surface on which a futon rests. These slats 154 are so positioned to provide a planar surface and, in combination with the side members and the cross members, form a planar seat, back, and rear deck surfaces on which the futon rests.

The rear deck 116 is pivotably connected to the back 114 with hinges 156 which attach to the back top cross member 136 of the back 114 and the back cross member 150 of the rear deck 116. A first rear deck support 158 pivotably attaches to the base 102 and to the first rear deck side member 146. A second rear deck support 160 pivotably attaches to the second rear deck side member 148 and to the base 102.

When direct connection is made between the rear deck 116 and the base 102 with single element rear deck supports (158, 160), it is preferred that adjustment slots 162 (shown in FIG. 10) be provided in the rear deck supports (158, 160) and that these slots 162 are spring loaded and similar in character to the slots shown in FIGS. 7 and 8. These slots 162 allow accommodation to be made for misalignment between the members which may result from a variety of causes including having the futon frame 100 resting on an irregular surface.

Pivoting deck legs 164 are attached to the rear deck 116 which provide additional stability to the futon frame 100 when the frame 100 is open to form a bed. If the deck legs 164 are to be self storing and mounted on the rear deck supports (158, 160), then the deck legs 164 must attach at a point which will remain at or above the height which is greater than the distance between the rear deck side member 146 and the ground when the futon frame 100 is in the open position.

Figure 12:
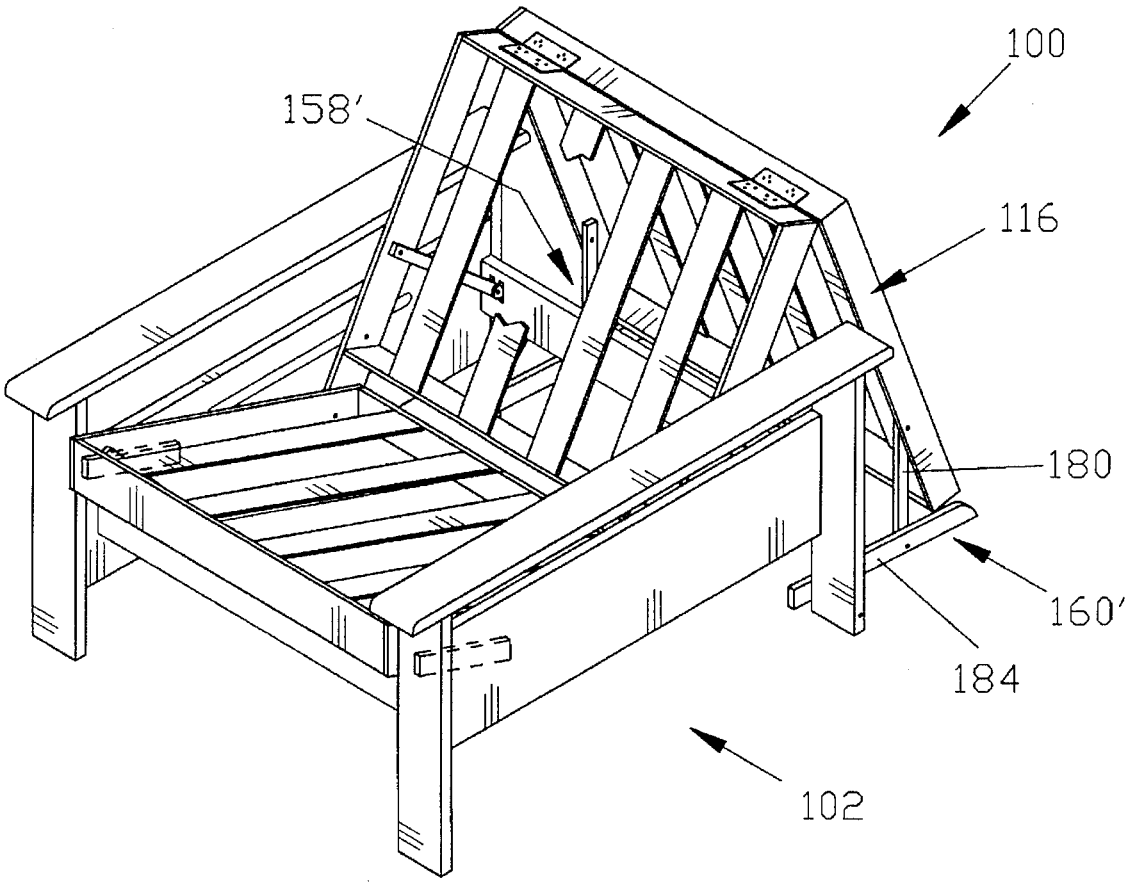
FIG. 12 is an isometric view of a futon frame similar to the futon frame of FIG. 9. Two-part rear deck supports are employed to accommodate misalignment between frame elements which could effect the opening of the frame.
Figure 15:
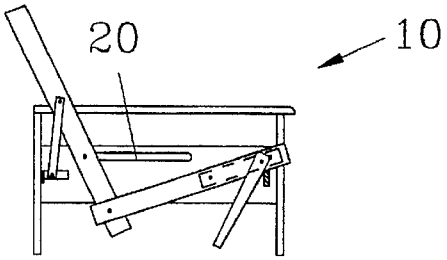
FIGS. 15 through 20 are side views of the frame of FIG. 1 where substantially horizontal base end slots are employed in various stages of opening.

While the use of slots in the rear deck supports (158, 160) can provide for adjustment of the rear deck supports (158, 160) as shown in FIG. 9, the adjustability can be provided by employing two-part rear deck supports (158', 160') such as shown in FIG. 12. This provides for adjustability by providing a first segment 180 which attaches to the rear deck 116 and a second segment 184 which attaches to the base 102. The first segment 180 is pivotably connected the second segment 184.

Similarly, by using segmented seat links, it is possible to provide means for altering the kinematics of the seat and back movement and to reduce the force needed to open and close the futon frame. However, this solution has its limitations in that by so doing one reduces the stabilizing action in the open position since there is less stability against compressive loads of the seat supports.

Figure 13:
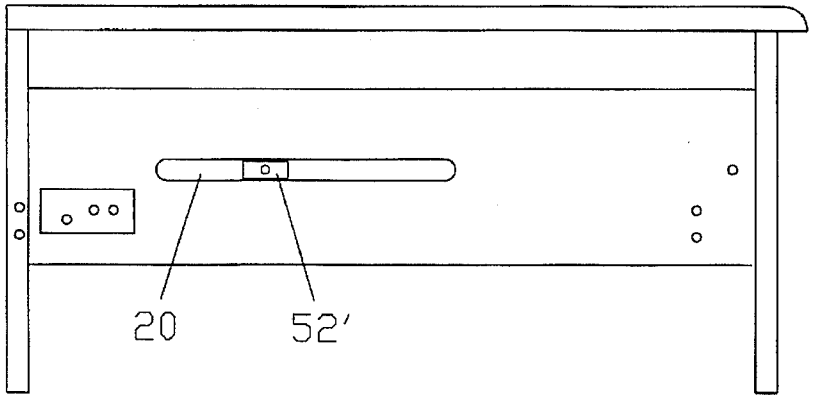
FIG. 13 is a section 13—13 of FIG. 1 which shows a slider itself as a movable bearing slot surface.

An alternative and preferred means for altering the kinematics of the movement of the seat and the back to reduce the forces needed to raise and lower the futon frame is to alter the shape of the base end slots which engage the back pivot pins. If the base end slots (16, 20) of the futon frame 10 of FIG. 1 are modified from substantially horizontal slots as illustrated in FIG. 13 to slots with a serpentine path such as the base end slot 20' illustrated in FIG. 14, the kinematics of the opening and closing will be substantially changed. In addition to reducing the forces needed to open and close the futon frame, the new path is swept out by the supplemental support legs (72, 76) with 76 being shown in FIGS. 21 through 28. These serpentine slots are particularly advantageous for futons which are thick or tend to conform to the frame and adopt its shape.

It has been found that it is further preferred that the serpentine path have three segments, a rear segment, a middle segment, and a forward segment. The rear segment, which is about one fourth (¼) of the length of the traversed path, rises to a maximum height at the point where it meets the middle segment. The middle segment is about one half (½) of the total path length and falls off from the maximum height, to the lowest point on the path. The forward segment, which communicates with the middle segment, is the last one fourth (¼) of the length of the path and again rises.

It is further preferred that the maximum slope for the middle segment be less than about 15° which limits the force which needs to be applied to the seat in closing the futon frame 10'.

It is further preferred that the rise from the low point of the rear segment should be about one half (½) of the rise from the low point in the forward segment. Having a steeper grade for the forward segment of the path brings a second benefit in that the seat 32 will rise more rapidly carrying the supplemental support legs (72, 76) further backward and assuring that the supplemental support legs (72, 76) are behind the base forward cross member 68 as they are lowered.

Figure 14:
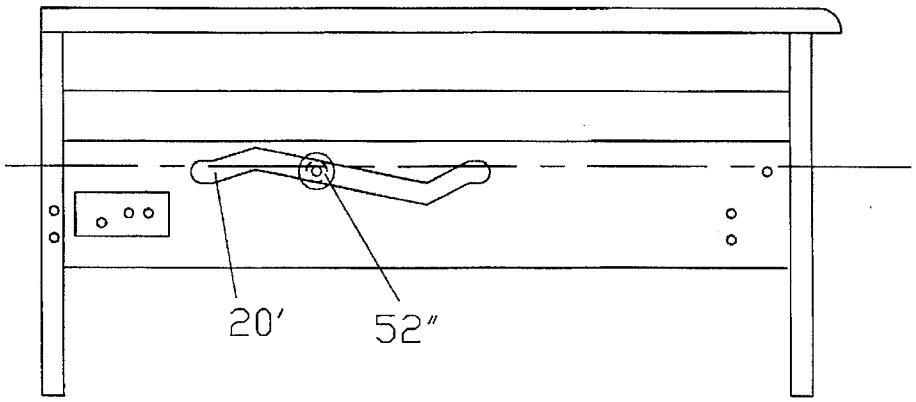
FIG. 14 is a section 13—13 of FIG. 1 for a modified embodiment wherein the substantially horizontal base end slots have been changed to serpentine slots and the sliders have been replaced by a rollers.

In order to illustrate the distinctions between the movement associated with opening a couch which employs substantially horizontal slots such as the base end slot 20 of FIG. 13 and a couch which employs serpentine slots such as the base end slot 20' shown in FIG. 14. A series of side views for each couch are illustrated in FIGS. 15 through 26. FIGS. 15 through 20 show the futon frame 10 relative positions between a closed position and an open position for a frame with a straight slot. FIGS. 21 through 26 illustrate the same relative positions for the futon frame 10' where the base end slot 20' has a serpentine path.

As can be seen by comparing the FIGS. 15 and 21 and FIGS. 20 and 26, the closed position of each of the frames is the same and the open position is the same; the distinction occurs at intermediate positions.

Figure 27:
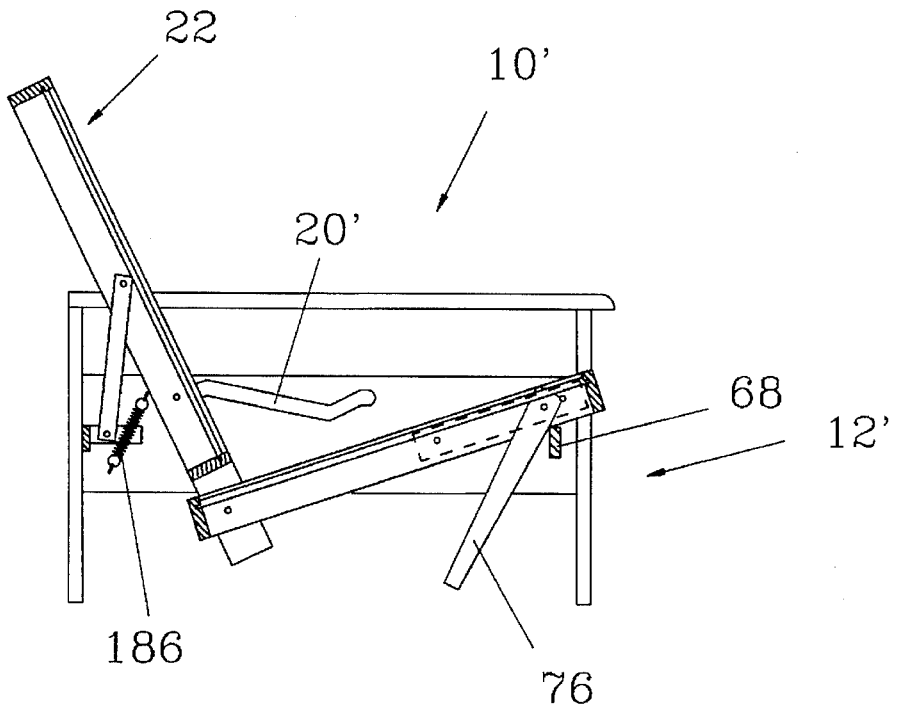
FIG. 27 is a cross section for a frame of the type illustrated in FIG. 1 with the serpentine slot of FIG. 14. This embodiment differs from the embodiment of FIG. 14 in that a spring has been supplied which attaches to the frame to provide assistance in the closing of the frame.
Figure 28:
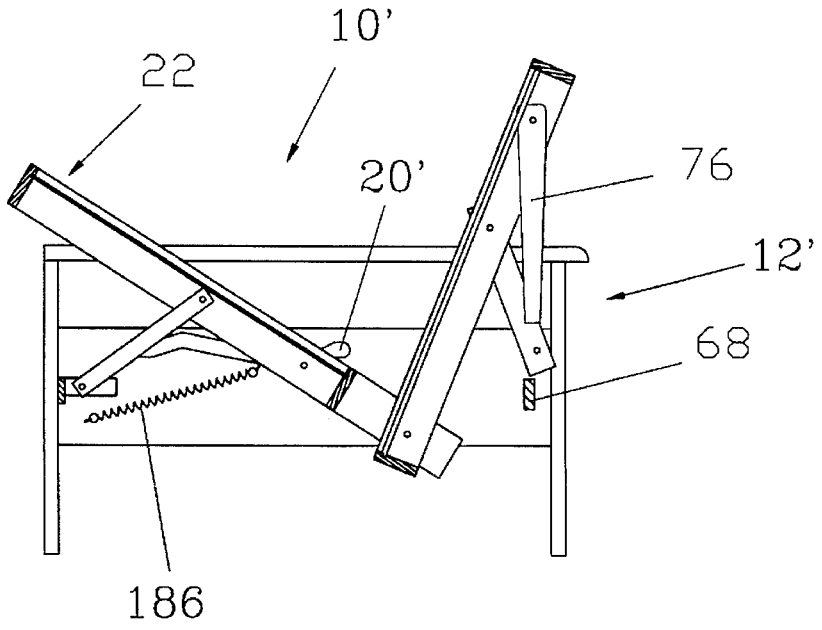
FIG. 28 illustrates the frame of FIG. 27 in the partially open position and illustrates the spring where the spring has been stretched, increasing the strain. In this position, the spring is assisting in closing the frame.

FIGS. 27 and 28 illustrate another embodiment of the present invention which employs a serpentine slot such as the base end slot 20' illustrated in FIG. 27 and 28. This embodiment also provides springs which are attached to a base 12' and to the back 22.

As the couch opens, as illustrated in FIG. 28, the spring is elongated and will tend to return the futon frame 10' to a closed position. When the futon frame 10' is fully open, due to the locking character of the frame, it will remain open.

To more fully illustrate the benefit of the invention, the following examples are offered:

EXAMPLE 1

A frame was built in the configuration shown in FIG. 1. This frame was constructed with a substantially horizontal base end slot and maintains the separation of the axes as follows:

AB 10 inches

BC 8¼ inches

CD 8¼ inches

DE 15¾ inches

It was found that when the length CD was reduced to about one half (½) of BC, the futon frame was much more difficult to raise when a heavy futon was employed and when the futon frame was on a hard surface, the futon tended to slide.

EXAMPLE 2

The futon frame of EXAMPLE 1 was modified by providing a serpentine base end slot where the length of the sections were:

Rear segment: 3 inches

Middle segment: 6 inches

Front segment: 3 inches

Rise in rear segment: 1 inches

Rise in front segment: 2 inches

Max. grade of middle segment: 15°

It was found that the use of the serpentine base end slot was effective in facilitating the raising and lowering of frames which had thick non-compliant futons placed thereon. It also worked well for futons which had a tendency to conform to the futon frame and adopt its shape when folded into a seat configuration.

Figure 16:
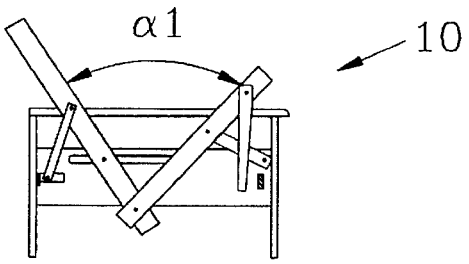
Figure 17:
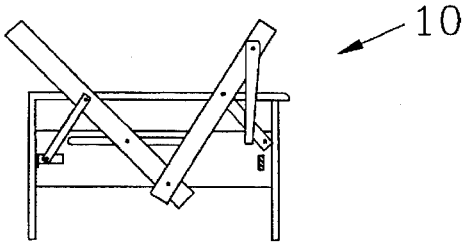
Figure 22:
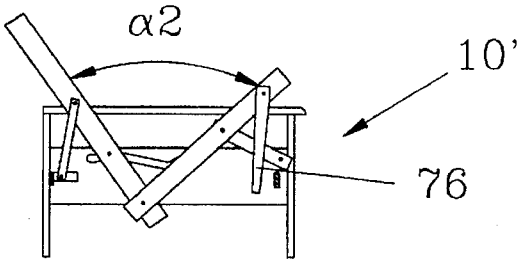
Figure 23:
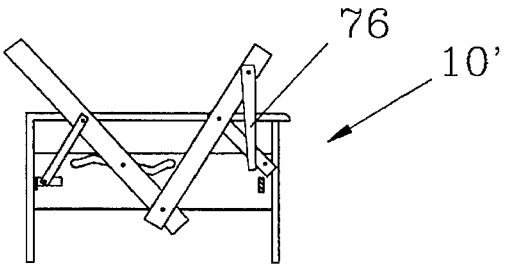

FIGS. 16 and 22 show the futon frames 10 and 10' in the early stage of opening. When opening the futon frame, the futon on the couch may, depending on its thickness and resilient character, tend to wedge in the corner generated at the intersection of the back and seat.

Comparing FIGS. 16 and 22, it can be seen that the angle $\alpha_1$ for the couch with the substantially horizontal base end slot 20 is less than the angle $\alpha_2$ for the couch with the serpentine base end slot 20'. Maintaining a more open angle $\alpha_2$ will result in the lessening of the compression of the futon frame 10' during the early portion of the opening of the frame 10' to form a bed. This is beneficial to the opening since the futon, after it has conformed to the seat 32 by persons sitting thereon, will be wedged into the corner and resist further compression.

Figure 18:
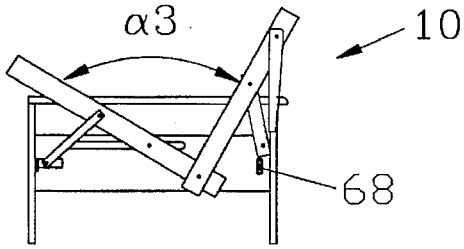
Figure 19:
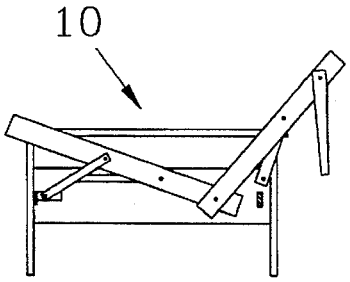
Figure 20:
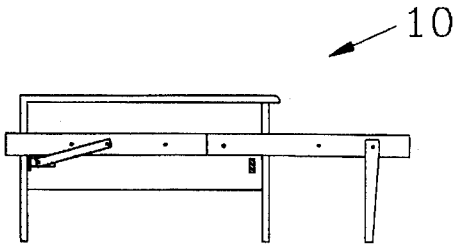
Figure 21:
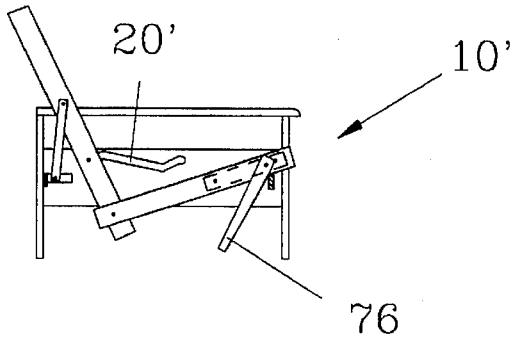
FIGS. 21 through 26 are side views at the same stage of opening as FIGS. 15 through 20 where the substantially horizontal base end slots have been changed to serpentine base end slots.
Figure 24:
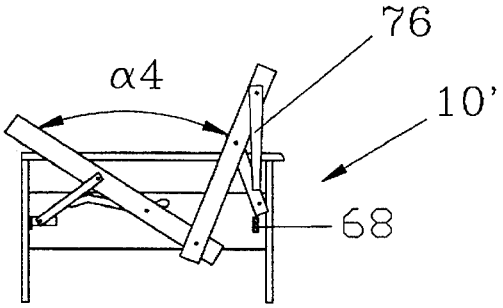
Figure 25:
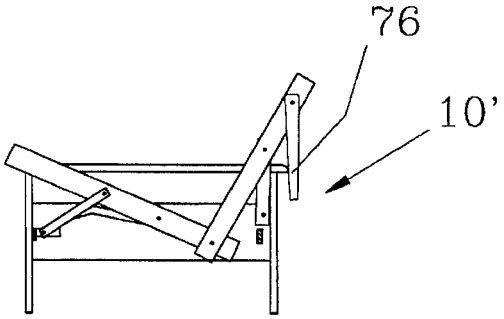
Figure 26:
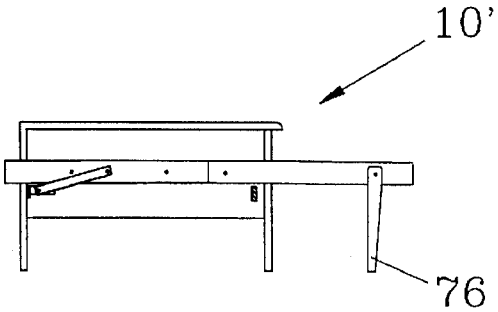

Also by comparison of FIGS. 18 and 24, one can see that while the angle $\alpha_4$ on the futon frame with the serpentine base end slot 20' is less than $\alpha_3$ on the futon frame with the substantially horizontal base end slot 20, this is in the mid-portion of the opening cycle thus, the futon frame 10' has greater freedom of movement. Furthermore, it can be seen that the legs have risen higher thereby assuring that the supplemental support legs (72, 76) will fall behind the base forward cross member 68 as the legs (72, 76) are lowered.

Figure 29:
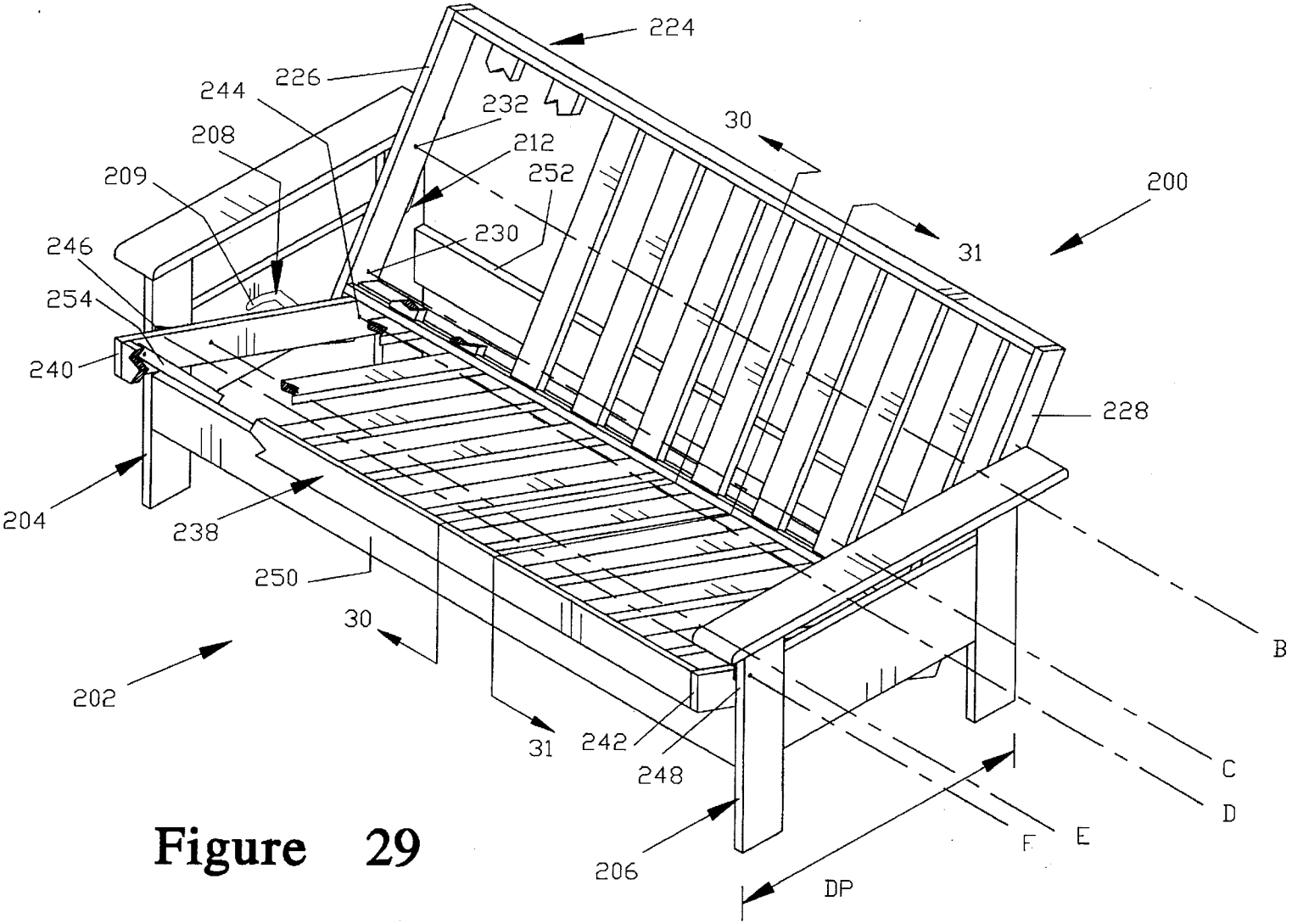
FIG. 29 is an isometric view of a futon frame of the present invention which employs a pair of base end lower serpentine slots, a pair of base end upper serpentine slots and a pair of seat supports to guide the seat and back of the futon frame from a closed position where the futon and frame will serve as a couch to an open position where the futon and frame will serve as a bed. The pair of base end upper serpentine slots provide support for the back at a substantial distance from the seat. Such a configuration of the base end upper serpentine slots requires relatively high arms.
Figure 30:
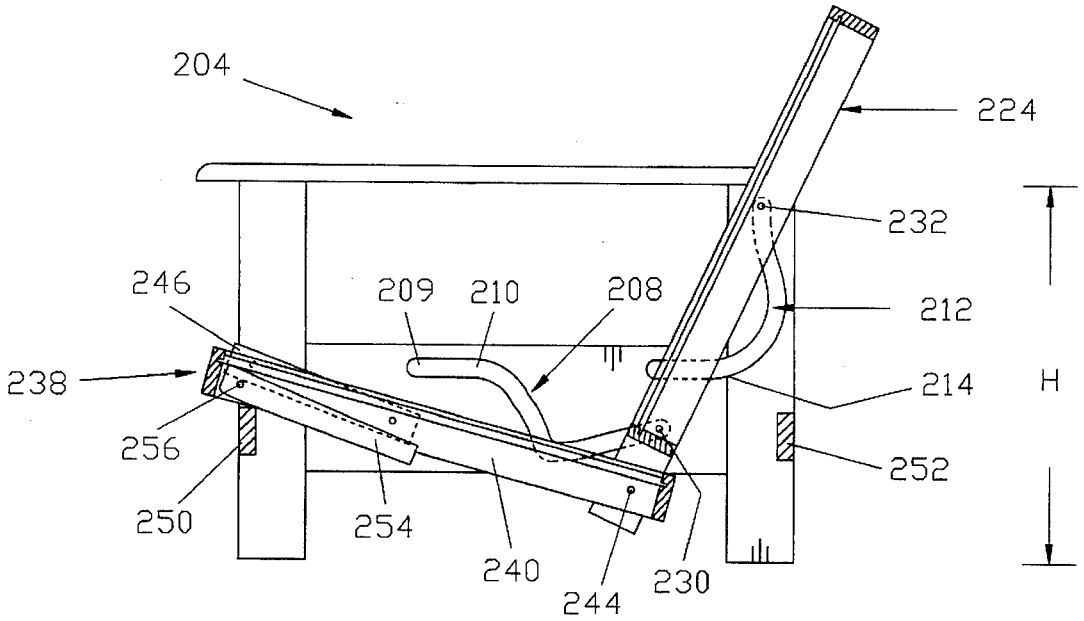
FIG. 30 is a section 30—30 of FIG. 29 which illustrates the first base end lower serpentine slot and the first base end upper serpentine slot, and further illustrates the alignment between the first horizontal lower slot forward segment and the first upper slot forward segment.

FIG. 29 is an isometric view of a futon frame 200 which illustrates an embodiment of the present invention which eliminates back supports such as the back supports (56, 60) of the embodiment illustrated in FIG. 1. The futon frame 200 is similar the futon frame 10 of FIG. 1. The futon frame 200 has a base 202 which has a first base end 204 and a second base end 206. The first base end 204 has a first base end lower serpentine slot 208 which has a first lower slot forward end 209. It is preferred that the first base end lower serpentine slot 208 have a first horizontal lower slot forward segment 210 as illustrated in FIG. 30 which terminates at the first lower slot forward end 209. A first base end upper serpentine slot 212 (best illustrated in FIG. 30) is also provided in the first base end 204 of the futon frame 200. The first base end upper serpentine slot 212 has a first horizontal upper slot forward segment 214 which is aligned with the first horizontal lower slot forward segment 210.

Figure 31:
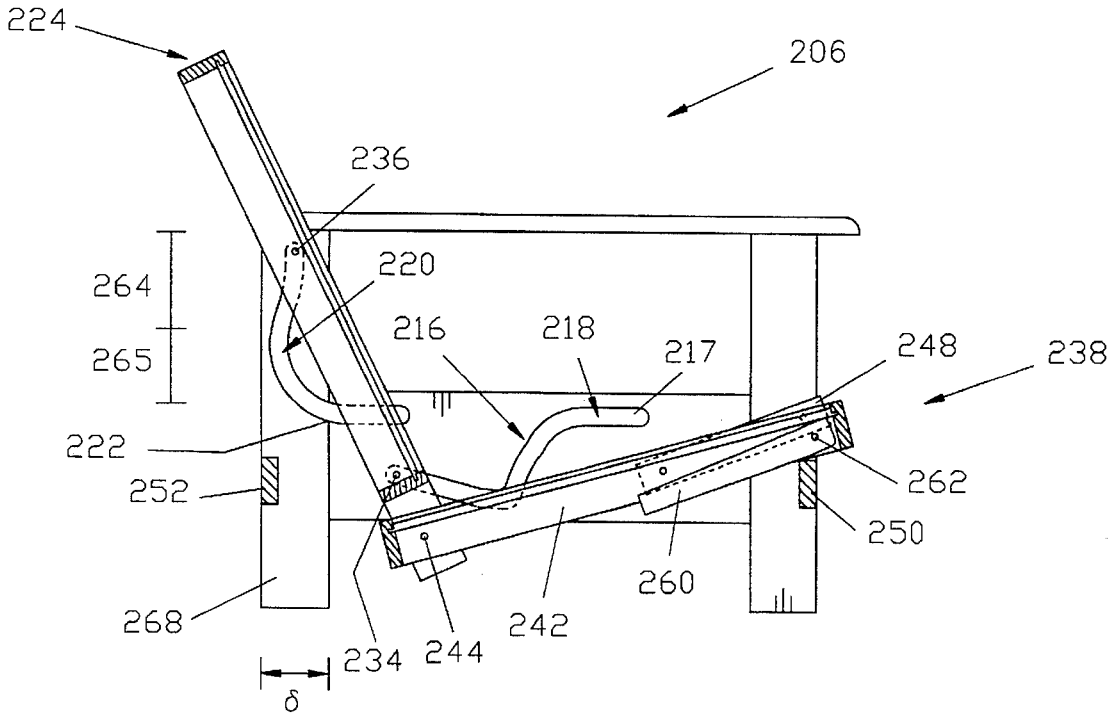
FIG. 31 is a section 31—31 of FIG. 29, illustrating the paths of the second base end lower serpentine slot and the second base end upper serpentine slot and further illustrates the alignment between the second horizontal lower slot forward segment and the second upper slot forward segment.

The second base end 206 is provided with a second base end lower serpentine slot 216 illustrated in FIG. 31 which is a cross-section 31—31 of FIG. 29. The second base end lower serpentine slot 216 has a second lower slot forward end 217. It is preferred that the second base end lower serpentine slot 216 has a second horizontal lower slot forward segment 218 as shown which terminates in the second lower slot forward end 217. The second base end 206 also has a second base end upper serpentine slot 220 which has a second horizontal upper slot forward segment 222 which is aligned with the second horizontal lower slot forward segment 218.

Referring again to FIG. 29 the futon frame 200 has a back 224 having a first back side member 226 and a second back side member 228. The first back side member 26 has a lower first back pivot pin 230 and an upper first back pivot pin 232 attached thereto. The lower first back pivot pin 230 engages the first base end lower serpentine slot 208 and the upper first back pivot pin 232 engages the first base end upper serpentine slot 212 (best illustrated in FIG. 30).

The second back side member 228 has a lower second back pivot pin 234 and a upper second back pivot pin 236 attached thereto as illustrated in FIG. 31. The lower second back pivot pin 234 engages the second base end lower serpentine slot 216 and the upper second back pivot pin 236 engages the second base end upper serpentine slot 220.

The upper first back pivot pin 232 and the upper second back pivot pin 236 in combination with the first base end upper serpentine slot 212 and the second base end upper serpentine slot 220 provide support to the back 224 and eliminate the need for the back support members (56, 60) required for the embodiment illustrated in FIG. 1. Elimination of the first and second back supports 56 and 60 allows for the foreshortening of the depth DP (illustrated in FIG. 29) of the base 202 providing a shallower base.

A seat 238 having a first seat side member 240 and a second seat side member 242 is pivotably attached to the back 224 with seat pins 244. It should be noted that in this embodiment, the free play associated with the base end upper serpentine slots eliminates the preference for the oblong passages (46, 48) as described for the embodiment of FIG. 1.

A first seat support 246 is pivotably attached to the first seat side member 240 and to the base 202 (best shown in FIG. 30) and a second seat support 248 is pivotably attached to the second seat side member 242 and to the base 202 (best shown in FIG. 31).

The futon frame 200 of this embodiment has five axes of rotation rather than six as does the embodiment illustrated in FIG. 1. The first axis A of FIG. 1 is eliminated while the axes B, C, D, E, and F are retained. The elimination of the axis A has resulted from the elimination of the back supports. The axis B is the axis on which the upper first and second back pivot pins (232 and 236) lie.

For the futon frame 200, it is preferred that as the separation between axis F and axis E (corresponding to the throw of the first and second seat supports (246 and 248)) is increased from the length employed when back supports are employed, that the separation between axis D (the pivotal point between the seat 238 and back 224) and axis E (the pivotal point of the first and second seat supports (246 and 248) be increased by an equivalent amount. This will serve to maintain the centering of axis D to ensure stability when the futon frame 200 is used in the closed position.

Reducing the separation between axis D and axis C relative to the separation between axis C and axis B allows a reduction in the rise needed of the segments of serpentine paths of the first and second base end lower serpentine slots (208 and 216) which guide the lower back pivot pins (230, 234) during the initial stages of opening and the final stages of closing the futon frame 200. This serpentine slot configuration reduces the tendency of the frame 200 to open suddenly and also reduces the force necessary during the final stages of closing thereby facilitating opening and closing the futon frame 200 with one hand.

It should be noted that such spacing of axes B, C, and D requires a steeper rise in the serpentine paths of the first and second base end lower serpentine slots (208 and 216) where the lower first and second back pivot pins (230 and 234) engage the first and second base end lower serpentine slots (208 and 216) during the final stage of opening and first stage of closing. This steeper rise near the final open position provides a retarding force to reduce the fall of the back 224 as the futon frame 200 is opened and decreases the amount of force needed to begin closing the futon frame 200 from the open position.

It has been found that the axis separations and path specifications of Example 3 below are well suited for a futon frame 200 of FIG. 29 which is designed to support a double size futon.

EXAMPLE 3

The approximate separation of the axes were as follows:

BC 12 inches

CD 4¼ inches

DE 15¼ inches

The length of the segments of the lower serpentine slot were:

Rear segment: 6¼ inches

Middle segment: 4¼ inches

Front segment: 2 inches

Fall in rear segment: grade approximately 15° for the first 4¾ inches and approximately 0 inches thereafter;

Max. grade of middle segment: approximately 60°;

Rise in front segment: grade approximately 0°.

The frame 200 illustrated has a base forward cross member 250 which attaches to the first base end 204 and the second base end 206. An aft cross member 252 is also provided which attaches to the first base end 204 and the second base end 206.

Again referring to FIGS. 30 and 31, FIG. 30 illustrates the frame 200 in the closed position and best illustrates a first supplemental support leg 254 which is pivotably attached to the first seat side member 240 with a first support pin 256 which lies forward of the forward cross member 250. Having the first supplemental support leg 254 so positioned assures engagement of the first supplemental support leg 254 with the base forward cross member 250 allowing the seat 238 to lower to the closed position without interference by the first supplemental support leg 254.

FIG. 31 shows a second supplemental support leg 260 similarly attached to the second seat side member 242 by a second support pin 262.

FIGS. 32 through 35 illustrate the futon frame 200 of FIG. 29 in a series of positions as the futon frame 200 moves from the closed position where it will serve as a couch to the open position where it will serve as a bed.

The movement of the back 224 and the seat 238 will be discussed in terms of the interactions of the second back pivot pins (234, 236) with respect to the second base end serpentine slots (216, 220). The same relative action will occur between the first back pivot pins (230, 232) and the first base end serpentine slots (208,212).

Figure 32:
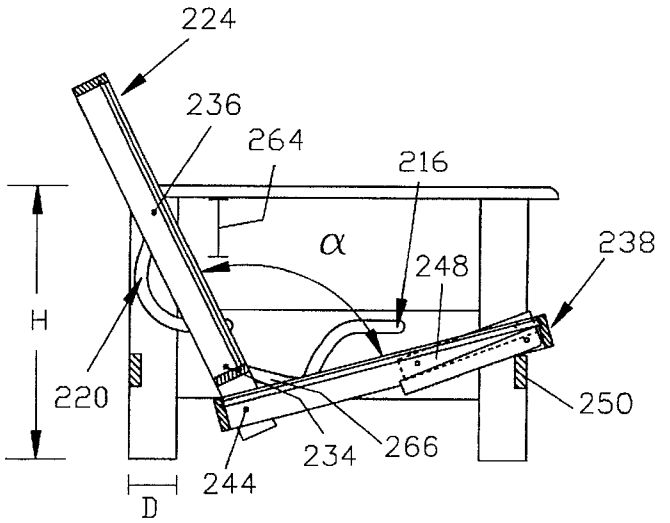
FIGS. 32 through 35 illustrate the futon frame illustrated in FIG. 29 at four positions demonstrating how the frame moves from a closed position to an open position without a substantial reduction in the angle $\alpha$ between the seat and the back.
Figure 34:
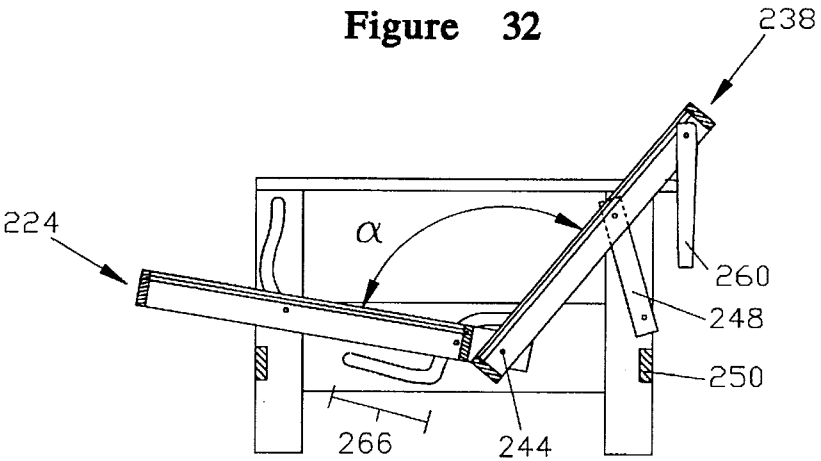

FIG. 32 illustrates a cross section of the futon frame 200 when the futon frame 200 is in the closed position. In this position, the upper second back pivot pin 236 is positioned in an upper substantially vertical slot segment 264 of the second base end upper serpentine slot 220 and the lower second back pivot pin 234 is at a lower slot rear segment 266 of the second base end lower serpentine slot 216 (the lower slot rear segment 266 is best shown in FIG. 34). When the seat 238 is so positioned, the seat 238 is supported by the seat pins 244 and the base forward cross member 250.

Figure 33:
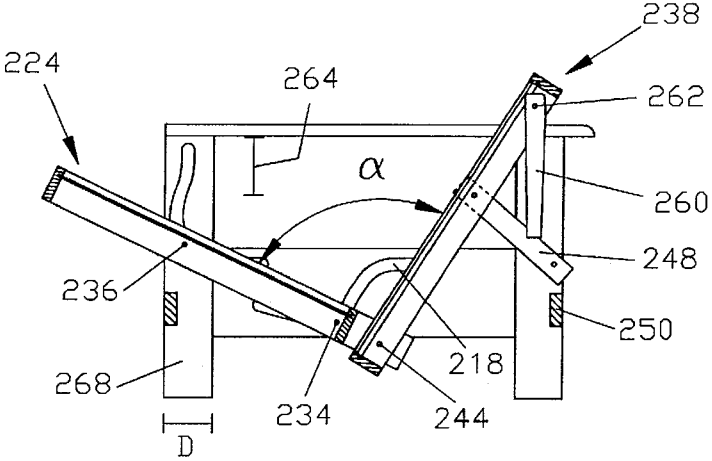

As the seat 238 is initially tilted to an intermediate position raising the second supplemental support leg 260 the second supplemental support leg 260 will drop to a vertical position but will remain above the base forward cross member 250 as illustrated in FIG. 33. The second seat support 248 causes the lower second back pivot pin 234 to move forward toward the second horizontal lower slot forward segment 218. As the lower second back pivot pin 234 moves forward the upper second back pivot pin 236 moves down the upper substantially vertical slot segment 264 of the second base end upper serpentine slot 220 and the back 224 swings away from the seat 238 as the seat 238 is tilted. This action assures an angle $\alpha$ between the seat 238 and the back 224 which remains large as the frame is opened. To facilitate a smooth action during opening, it is further preferred that an upper middle curved slot segment 265 (shown in FIG. 31) of the second base end upper serpentine slot 220 be included between the upper substantially vertical slot segment 264 and the second horizontal lower slot forward segment 218. Referring to FIG. 31, the curve of the upper middle curved slot segment 265 is preferably such that the slot moves rearward and then swings forward to meet the second horizontal upper slot forward segment 222. Having this upper middle curved slot segment 265 requires rear legs 268 having a substantial depth $\delta$ not required by the embodiment illustrated in FIG. 1. Having the base end upper serpentine slots (212, 220) configured as illustrated in the embodiment shown in FIGS. 29–35 will provide for support of the back 224 at a substantial distance from the seat 238 making the back 224 more rigid when the futon frame 200 is in the closed position. However, having the base end upper serpentine slots (212, 220) so configured requires the base ends (204, 206) to have a substantial height H (noted in FIG. 30) to accommodate the base end upper serpentine slots (212, 220).

FIG. 34 illustrates the futon frame 200 as it is continued to be opened. The seat 238 has been further rotated with respect to the back 224 and the second supplemental support leg 260 is in front of the forward cross member 250. As the seat 238 is further advanced to the open position, the second supplemental support leg 260 is brought into contact with the surface on which the futon frame 200 rests.

Figure 35:
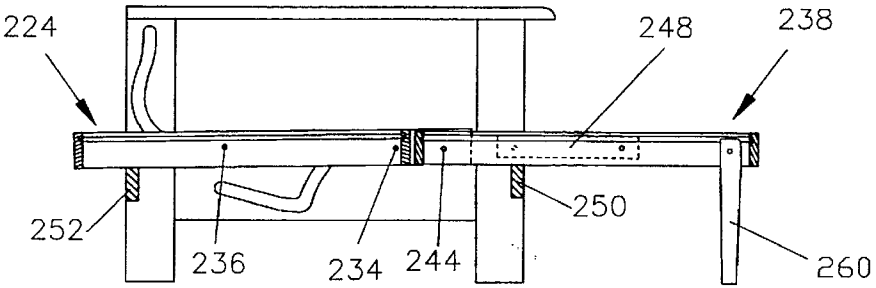

FIG. 35 illustrates the futon frame 200 in the fully open position. When the seat 238 and the back 224 are co-planar, the back 224 is supported by the upper back pivot pins (232, 236) and the lower back pivot pins (230, 234) as well as by the aft cross member 252 which is positioned to engage the back 224 when the futon frame 200 is in the open position. The seat 238 is supported by the supplemental support legs (254 and 260), the base forward cross member 250, and the seat pins 244. The structure is very stable since the upper back pivot pins (232, 236) and the lower back pivot pins (230, 234) are maintained in a linear relationship by the horizontal forward slot segments (214,222 and 210, 218) in which they reside. The structure is further stabilized by the large separation provided between the lower back pivot pins (230, 234) and the upper back pivot pins (232,236).

Figure 36:
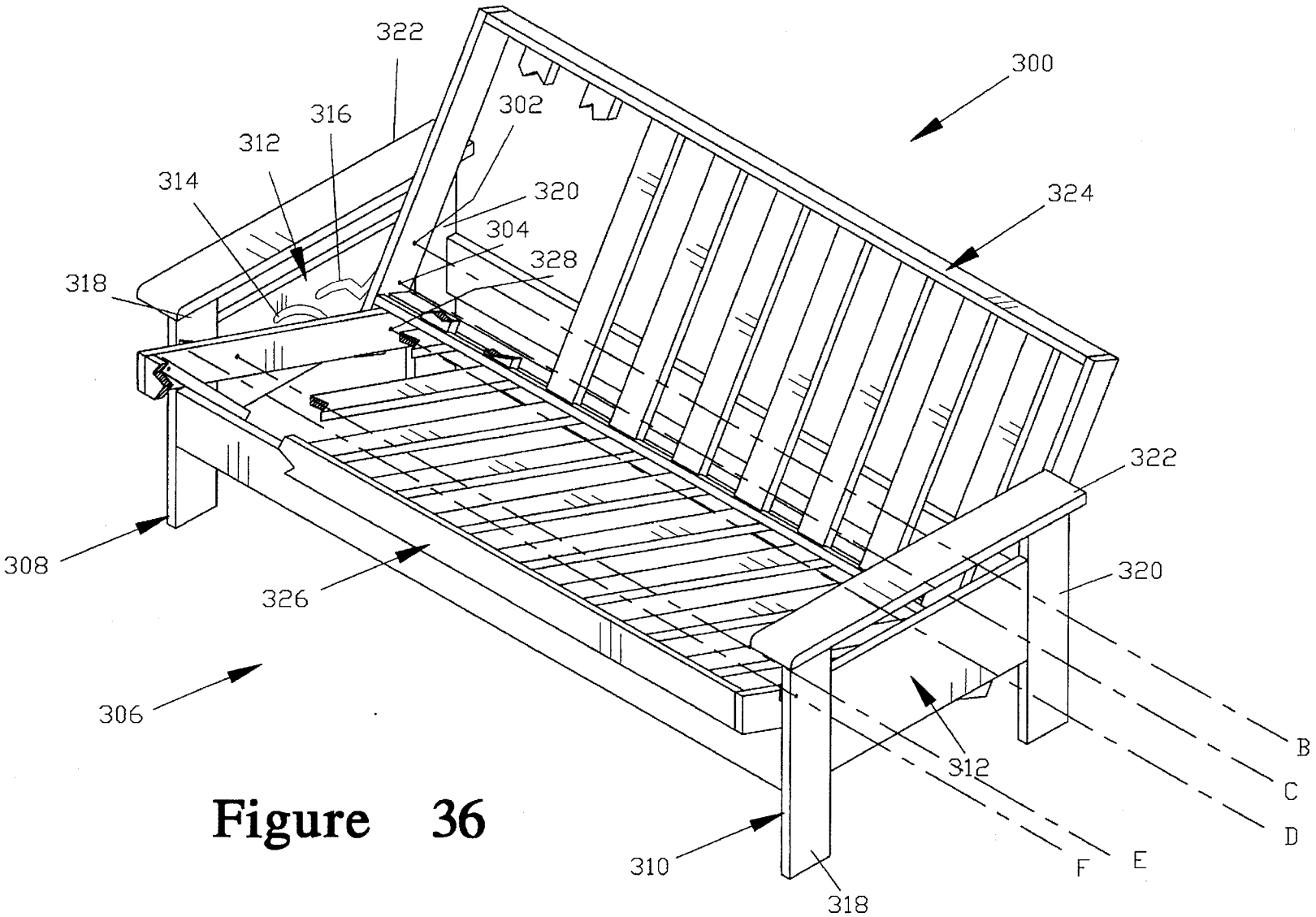
FIG. 36 is an isometric view of anther embodiment of a futon frame which uses first base end and second base end upper and lower serpentine slots. In this embodiment the upper and lower serpentine slots are positioned such that the arms can be set lower if desired.

FIG. 36 illustrates another embodiment of a futon frame 300 of the present invention where further freedom in the design of the base ends can be obtained without requiring back supports. In this embodiment the separation between the axes B and C which are defined by upper back pivot pins 302 and lower back pivot pins 304 is reduced. With such a design, a low arm (or even an arm-free) frame can be constructed. The futon frame 300 of FIG. 36 has a low profile base 306 with a low profile first base end 308 and a low profile second base end 310. Both of the base ends (308, 310) have central panels 312 in which reside base end lower serpentine slots 314 and base end upper serpentine slots 316. The central panels 312 terminate in front legs 318 and rear legs 320. Arm supports 322 terminate the front legs 318 and the rear legs 320.

Again the futon frame 300 employs the upper back pivot pins 302 and the lower back pivot pins 304 to position and guide a back 324 from an upright position of the closed frame to a horizontal position of the opened frame. The back 324 is pivotably attached to a seat 326 by seat pins 328.

It has been found that the axis separations and path specifications of Example 4 below are well suited for the futon frame 300 designed to support a double or queen size futon.

EXAMPLE 4

The approximate separations of the axes were as follows:

BC 5 inches

CD 4 inches

DE 15¼ inches

The length of the segments of the lower serpentine slot were:

Rear segment: 6¼ inches

Middle segment: 4¼ inches

Front segment: 2 inches

Fall in rear segment: grade approximately 15° for the first 4¾ inches and approximately 0 inches thereafter;

Max. grade of middle segment: approximately 60°;

Rise in front segment: grade approximately 0°.

The repositioning of the axes B and C requires a substantial change in the shape of the base end upper serpentine slots 316 (as can best be seen in FIGS. 37 through 40) and eliminates the substantially vertical segments present in the embodiment of FIGS. 29–35. FIGS. 37–40 illustrate a series of positions as the futon frame 300 is moved from the closed to the open position. These positions correspond to similar movement of the seat 326 about the axis F as the seat 238 in FIGS. 32–35. As can be seen by comparison the angle $\alpha$ between the seat 326 and the back 324 remains large, thus facilitating opening and closing the futon frame 300 by minimizing the resistance resulting from folding the futon.

Figure 37:
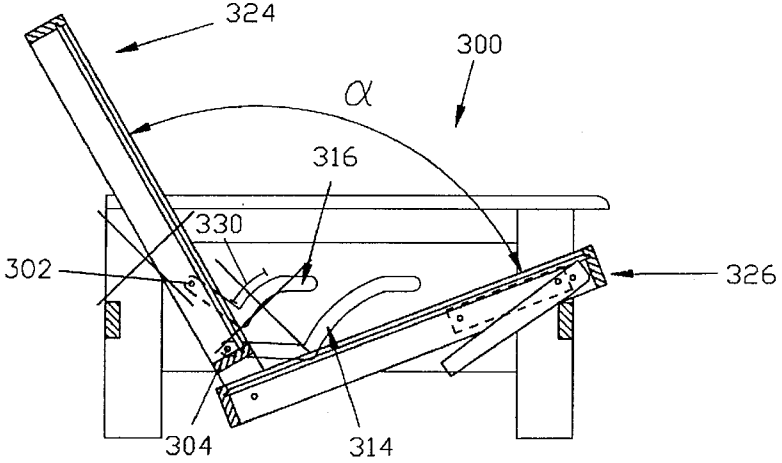
FIGS. 37 through 40 illustrate the futon frame illustrated in FIG. 36 at four positions demonstrating various positions through which the frame moves as it moves from a closed position to an open position. This transition between the closed position and the open position is accomplished without a substantial reduction in the angle a between the seat and the back.
Figure 38:
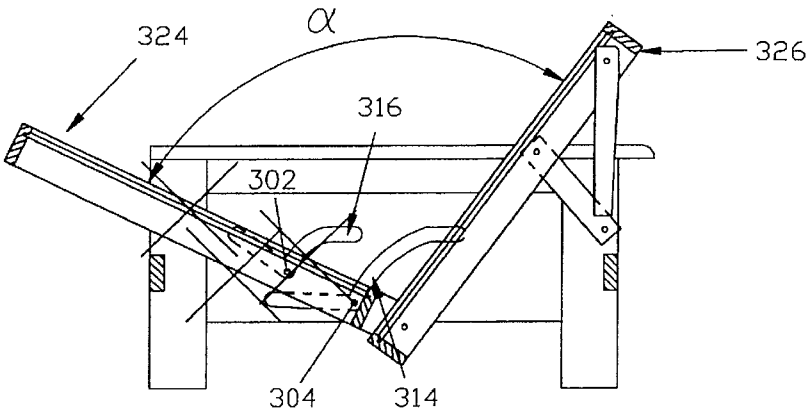
Figure 39:
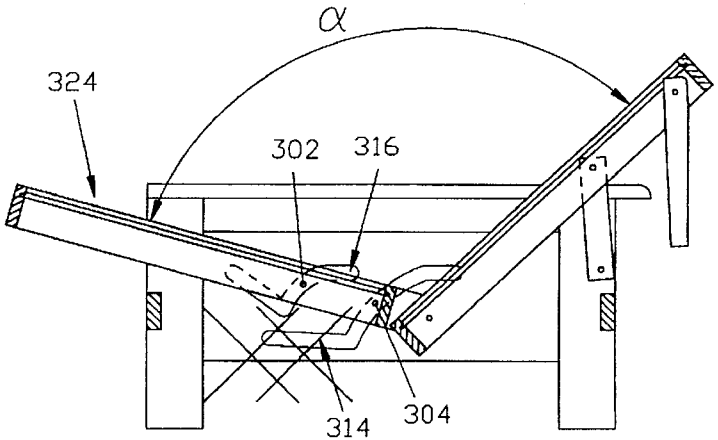
Figure 40:
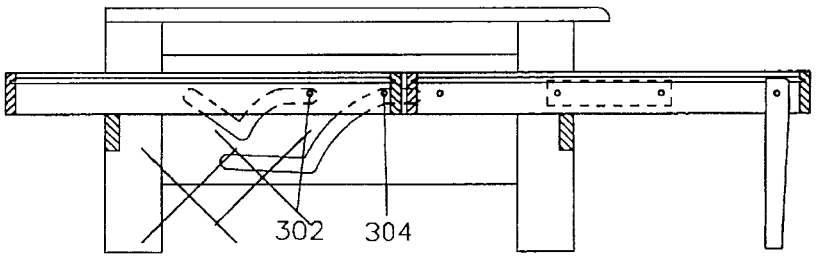
Figure 41:
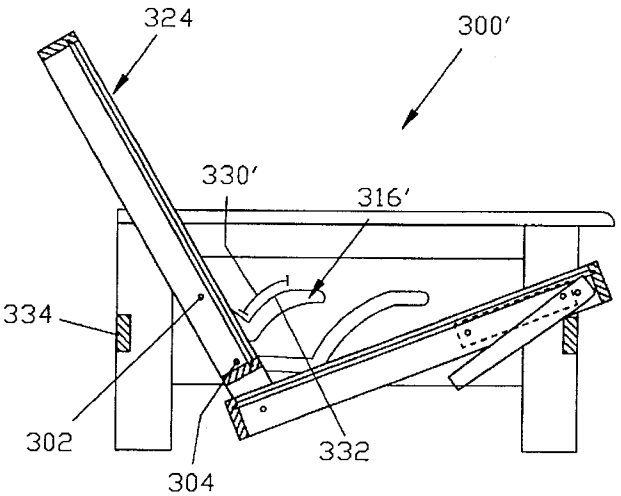
FIGS. 41 through 44 illustrate a futon frame similar to the embodiment of FIG. 36. This embodiment differs only in the details of the base end upper serpentine slots. The base end upper serpentine slots are oversized in the middle segment which will provide compensation for warpage or misalignment of the components of the frame. This oversized middle segment also allows the back to more rapidly drop, helping to maintain an open angle between the seat and the back.
Figure 42:
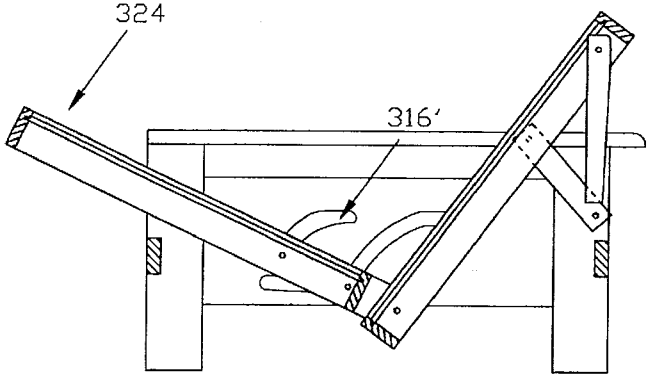
Figure 43:
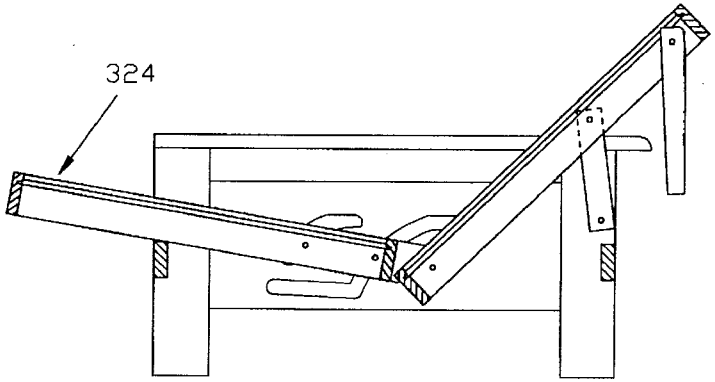
Figure 44:
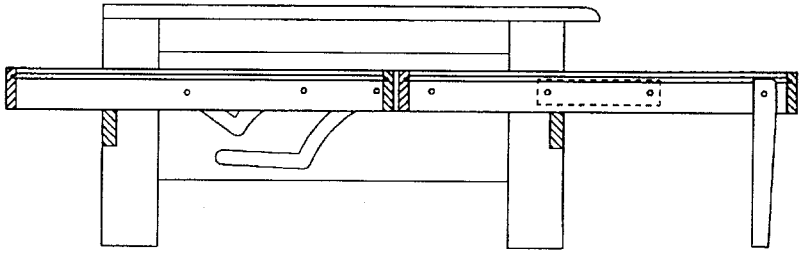

The futon frame 300 illustrated in FIG. 37 is in the closed position, which is the same position as the futon frame 200 illustrated in FIG. 32. As opening of the futon frame 300 is initiated by the lifting and advancing of the seat 326, the back 324 drops at about the same rate as did the back 224 for the futon frame 200. This drop rate of the back 324 with respect to the seat 326 continues at about the same rate until the lower back pivot pins 304 reach the bottom of the base end lower serpentine slots 314 as is illustrated in FIG. 38. At this point, due to the closer proximity of axes B and C, as the lower back pivot pins 304 start to ascend the base end lower serpentine slots 314 the back 324 will fall at a faster rate than occurs for the back 224 of futon frame 200. The contour of the base end upper serpentine slot 316 is critical to the proper functioning of the futon frame 300. The spacing of axes B and C is closer than in the embodiment of FIGS. 29 through 35, which makes maintaining a paired relationship between the axes B and C more critical. The close proximity of the axes B and C also makes the back 324 somewhat less stable when subjected to bending moments in the closed position.

The limited separation of axes B and C in the futon frame 300 can result in additional complications if the dimensional tolerances are not maintained resulting in a loss of their paired relationship. This problem can be alleviated by oversizing the base end upper serpentine slot 316 in a middle segment 330 where the slot is rising from its lowest position to the forward position where the slot becomes horizontal.

FIGS. 41 through 44 illustrate an alternative futon frame 300' where the base end upper serpentine slot 316' has been modified by opening the middle segment 330' of the base end upper serpentine slot 316' by raising an upper surface 332 of the middle segment 330' and allowing the back 324 to fall onto an aft cross member 334 and pivot thereon, thereby eliminating the criticality of the separation of the upper back pivot pins 302 and the lower back pivot pins 304.

The discussion of the embodiments illustrated in FIGS. 29 through 44 has been in terms of upper and lower back pivot pins engaging upper and lower serpentine slots. It should be appreciated that it is preferred that such engagement be via rollers mounted on the back pivot pins which engage the slots as was discussed earlier with respect to the embodiment illustrated in FIG. 14.

Figure 45:
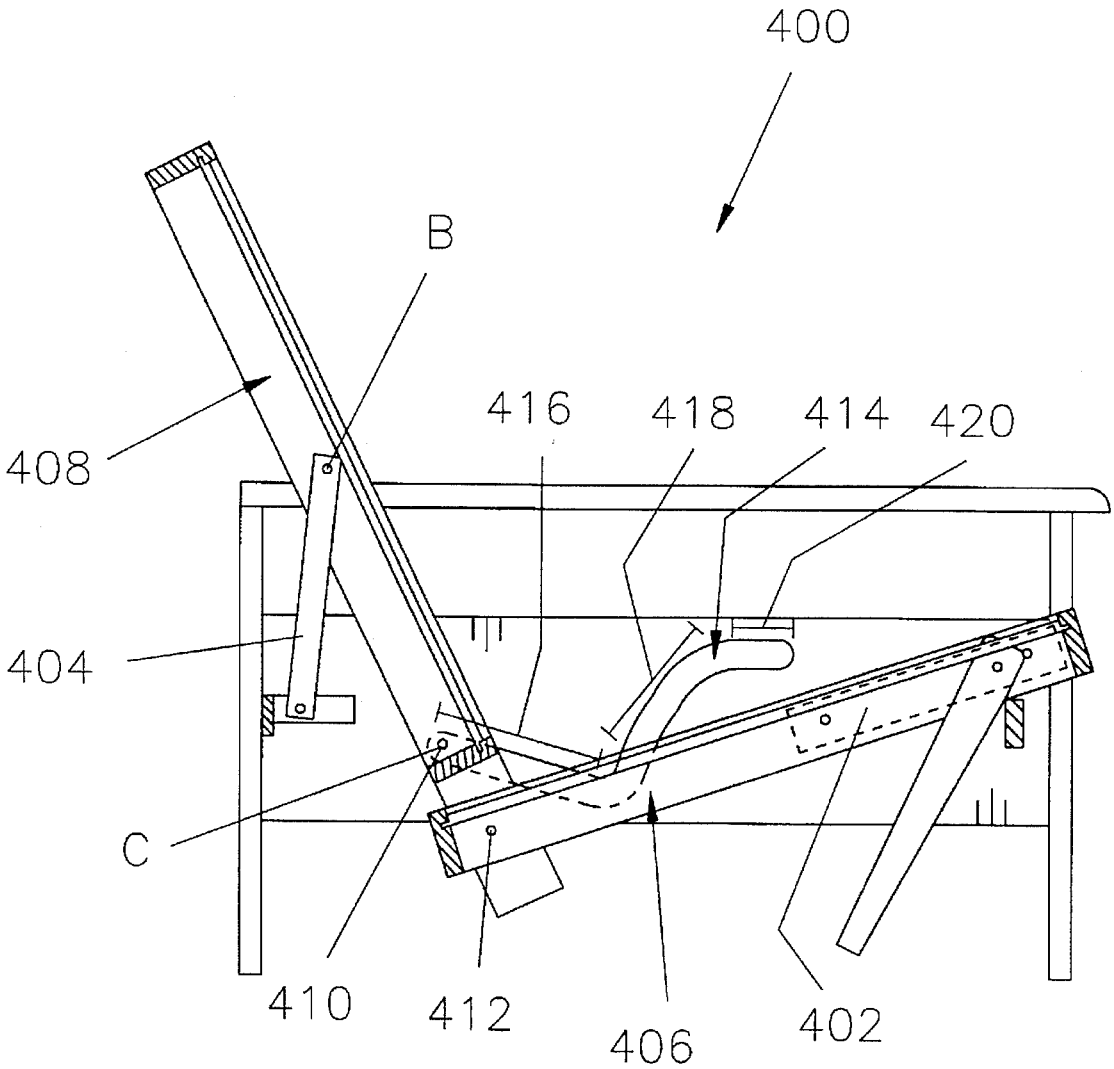
FIG. 45 illustrates an embodiment of the present invention which employs both back and seat supports as is the case of the embodiments illustrated in FIGS. 1–28. This embodiment differs from the earlier embodiments which employed both seat and back supports in the details of the base end slots which are serpentine slots similar to the base end lower serpentine slots of the embodiments of FIG. 29 and 36. This configuration increases the separation between axes A and B and increases the rigidity of the seat when the futon frame is in the open position.

FIG. 45 illustrates another embodiment of a futon frame 400 of the present invention where both seat supports 402 and back supports 404 are employed. The futon frame 400 is provided with increased rigidity of a seat 406 and back 408 in the open position by bringing back pivot pins 410 in closer proximity to seat pins 412. This reduces rocking between the seat 406 and the back 408. Serpentine slots 414 are provided having a configuration substantially the same as the serpentine paths of the base end lower slots (208 and 216) in the embodiments of FIGS. 29 through 44. While this configuration does maintain the stability when the frame is open, it requires large forces to close the frame.

The serpentine slots 414 have rear segments 416 with a shallow grade. These rear segments 416 are engaged by the back pivot pins 410 when the futon frame 400 is in the closed position and opening is initiated. As the futon frame 400 continues to be opened, the back pivot pins 410 are advanced along middle segments 418 having a steep grade and thereafter come to rest in forward segments 420 which are horizontal.

The serpentine slots 414 allow the back pivot pins 410 to be lowered from the position shown in the embodiment illustrated in FIG. 14 thereby increasing the separation between the axes B and C as well as bringing the back pivot pins 410 in closer proximity to the seat pins 412. The increased separation of the axes B and C in combination with bringing the seat pins 412 in closer proximity to the back pivot pins 410 increases the rigidity of the futon frame 400 in the open position. While this solution is adequate for full size beds it can result in large forces for frames which are designed to carry stiff queen size futons.

Values are provided in Example 5 for a series of axis separations and parameters for the geometry of the serpentine slots which have been found effective in production of the futon frame 400:

EXAMPLE 5

The separation of the axes were as follows:

AB 10 inches

BC 12¼ inches

CD 4¼ inches

DE 15¾ inches

The length of the segments were:

Rear segment: 6¼ inches

Middle segment: 4¼ inches

Front segment: 2 inches

Fall in rear segment: grade approximately 15° for the first 4¾ inches and approximately 0 inches thereafter;

Max. grade of middle segment: approximately 60°;

Rise in front segment: grade approximately 0°.

Figure 46:
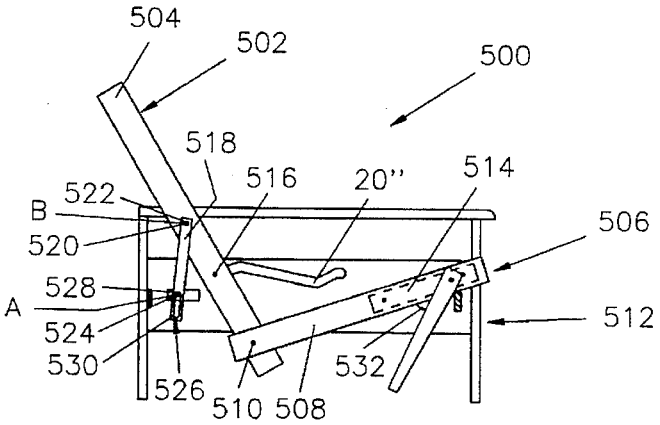
FIGS. 46 through 48 illustrate another embodiment of the present invention which employs both seat supports and back supports as does the embodiment of FIG. 45. In this embodiment the serpentine path of the embodiment of FIG. 14 is substituted for the serpentine path configuration illustrated in FIG. 45. To increase the stability of the seat and back in the open position, stabilizing rollers are provided which provide additional support for the back when the frame is open. To allow the back to swing past the stabilizing rollers as it is lowered, slots are provided in the back supports where they pivotably attach to the base, allowing the separation of axes A and B to be varied.
Figure 47:
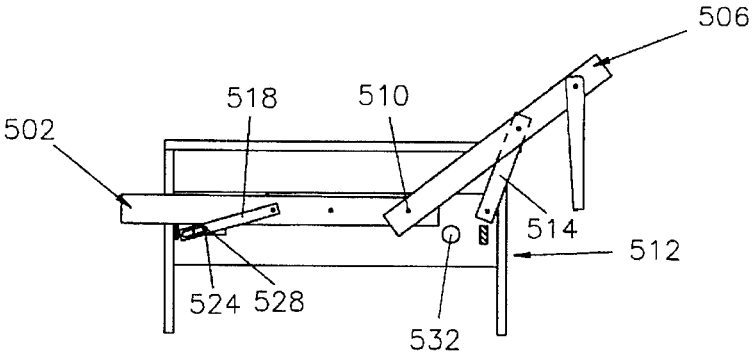
Figure 48:
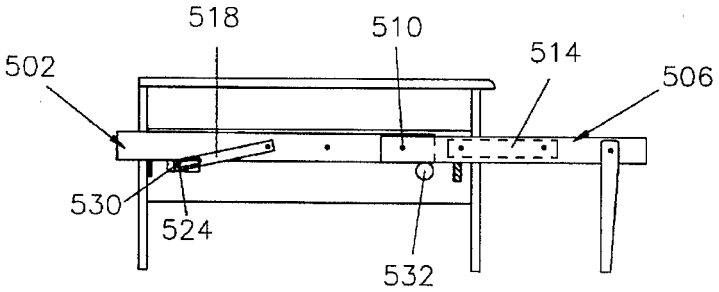

FIGS. 46–48 illustrate a futon frame 500 which is a modification of the futon frame illustrated in part in FIG. 14. This futon frame 500 is better suited than the embodiment of FIG. 36 for queen size futons and employs base end serpentine slots 20" configured the same as the serpentine slots 20' illustrated in FIG. 14. The futon frame 500 again has a back 502 having back side members 504 and a seat 506 having seat side members 508. Seat pins 510 pivotably engage the seat 506 with the back 502. The futon frame 500 has a base 512 and seat supports 514 are pivotably attached to the base 512 and to the seat side members 508.

The employment of the base end serpentine slot 20", while requiring smaller forces to open than the futon frame 400 of FIG. 45, provides less rigidity of the back 502 and seat 506 when the futon frame 500 is in the open position. Thus it is desirable to provide a means for increasing the rigidity when the futon frame 500 is open. Back pivot pins 516 are attached to the back side members 504 and engage the base end serpentine slots 20". Back supports 518 are provided which are pivotably connected to the back side members 504 and to the base 512. The back supports 518 are pivotably connected to the back side members 504 with back support pins 520 which are attached to the back side members 504 and pass through back support cylindrical holes 522 in the back supports 518. Pivotable as well as translational motion of the back supports 518 with respect to the base 512 is provided by base support pins 524 which engage back support slots 526 each of which has a front end 528 and a rear end 530. Stabilizing rollers 532 are provided and are rotatably mounted with respect to the base 512 such that when the base support pins 524 are engaged with the front ends 528, the back 502 will pass by the stabilizing rollers 532 but when the base support pins 524 engage the rear ends 530, the back 502 will engage the stabilizing rollers 532. The stabilizing rollers 532 are positioned in close proximity to the seat pins 510 and prevent any rocking between the back 502 and the seat 506 at their pivot point.

The range of axis separations and geometry of the serpentine path for the futon frame 500 for supporting a queen size futon are provided in Example 6.

EXAMPLE 6

The separation of the axes were as follows:

AB range 9 to 10 inches

BC 8¼ inches

CD 8¼ inches

DE 15¾ inches

The lengths of the segments were:

Rear segment: 3 inches

Middle segment: 6 inches

Front segment: 3 inches

Rise in rear segment: 1 inch

Rise in front segment: 2 inches

Max. grade of middle segment: 15°

While the employment of stabilizing rollers fixably mounted to the base has been described as a preferred means of increasing rigidity when the futon frame is in the open position, it should be appreciated that other means, such as movable rollers or sliding blocks could be employed. Similarly, when fixed stabilizers are employed, alternate means of bringing them back into engagement may be employed. Alternatively, back supports which are extended could be employed.

Figure 49:
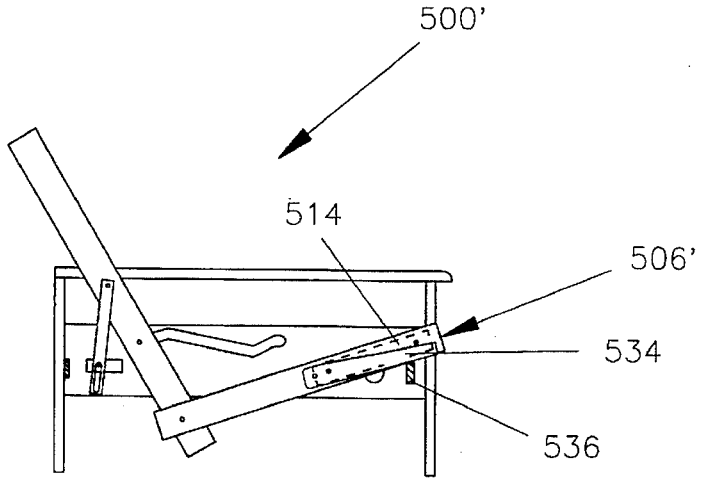
FIGS. 49 through 51 illustrate yet another embodiment of the present invention which is similar to the embodiment of FIGS. 46 through 48. This embodiment differs in the location of the supplemental support legs, which have been moved away from the front of the seat to prevent them from passing behind the front cross member.
Figure 50:
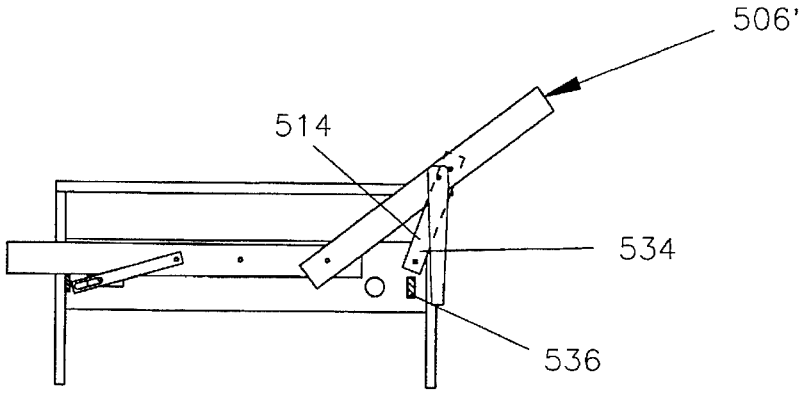
Figure 51:
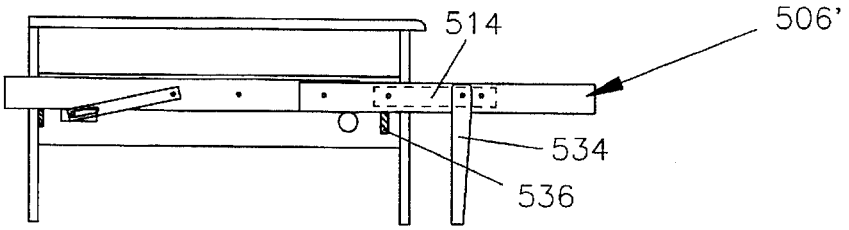

FIGS. 49 through 51 illustrate a futon frame 500' which differs from the futon frame 500 only in the position of supplemental support legs 534 that are pivotably connected to the seat 506' such that they will contact a front cross member 536 and be tilted forward as the seat 506' is lowered into the closed position.

While the invention has been described in terms of preferred embodiment, it should be appreciated that variations of the present invention are possible in light of the above teaching and that variations can be made without departing from the spirit of the invention.

What I claim is:

1. A futon frame for supporting a futon forming a chair or sofa when the futon frame is in a closed position and forming a bed when the futon frame is in an open position, the futon frame comprising:

a base having a first base end spaced apart from a second base end, said first base end having a first base end lower serpentine slot with a first lower slot forward end and a first base end upper serpentine slot with a first horizontal upper slot forward segment which is aligned with said first lower slot forward end, and said second base end having a second base end lower serpentine slot with a second lower slot forward end and a second base end upper serpentine slot with a second horizontal upper slot forward segment which is aligned with said second lower slot forward end;

a back having a first back side member and a second back side member;

a lower first back pivot pin and an upper first back pivot pin, each of said lower first back pivot pin and said upper first back pivot pin attaching to said first back side member and respectively engaging said first base end lower serpentine slot and said first base end upper serpentine slot;

a lower second back pivot pin and an upper second back pivot pin, each of said lower second back pivot pin and said upper second back pivot pin attaching to said second back side member and respectively engaging said second base end lower serpentine slot and said second base end upper serpentine slot;

a seat having a first seat side member and a second seat side member, said seat pivotably connecting to said back;

a first seat support pivotably connecting to said first seat side member and to said base; and a second seat support pivotably connecting to said second seat side member and to said base.

2. The futon frame of claim 1 further wherein;

said first base end lower serpentine slot has a first horizontal lower slot forward segment which terminates in said first lower slot forward end, and said second base end lower serpentine slot has a second horizontal lower slot forward segment which terminates in said second lower slot forward end.

3. The futon frame of claim 2 wherein said base further comprises:

a base forward cross member attached to said first base end and said second base end;

a first supplemental support leg pivotably attached to said seat;

a second supplemental support leg pivotably attached to said seat;

further wherein:

said first supplemental support leg has a first base forward cross member engaging surface; and said second supplemental support leg has a second base forward cross member engaging surface.

4. The futon frame of claim 3 further comprising:

a first roller interposed between said first base end lower serpentine slot and said lower first back pivot pin;

a second roller interposed between said first base end upper serpentine slot and said upper first back pivot pin;

a third roller interposed between said second base end lower serpentine slot and said lower second back pivot pin; and a fourth roller interposed between said second base end upper serpentine slot and said upper second back pivot pin.

5. The futon frame of claim 4 further comprising:

a base aft cross member attached to said first base end and said second base end;

further wherein:

said base forward cross member is positioned to engage said seat when the futon frame is in the open position and said base aft cross member is positioned to engage said back when the futon frame is in the open position.

6. The futon frame of claim 5 wherein:

said first base end upper serpentine slot and said second base end upper serpentine slot have a substantially vertical component.

7. The futon frame of claim 6 wherein said first supplemental support leg and said second supplemental support leg are pivotably mounted to said seat at points which are forward of said base forward cross member when the futon frame is in the closed position.

8. The futon frame of claim 1 wherein said base further comprises:

a base forward cross member attached to said first base end and said second base end;

a first supplemental support leg pivotably attached to said seat;

a second supplemental support leg pivotably attached to said seat;

further wherein:

said first supplemental support leg has a first base forward cross member engaging surface; and said second supplemental support leg has a second base forward cross member engaging surface.

9. The futon frame of claim 3 further comprising:

a first roller interposed between said first base end lower serpentine slot and said lower first back pivot pin;

a second roller interposed between said first base end upper serpentine slot and said upper first back pivot pin;

a third roller interposed between said second base end lower serpentine slot and said lower second back pivot pin; and a fourth roller interposed between said second base end upper serpentine slot and said upper second back pivot pin.

10. The futon frame of claim 9 further comprising:

a base aft cross member attached to said first base end and said second base end;

further wherein:

said base forward cross member is positioned to engage said seat when the futon frame is in the open position and said base aft cross member is positioned to engage said back when the futon frame is in the open position.

11. The futon frame of claim 10 wherein:

said first base end upper serpentine slot and said second base end upper serpentine slot have a substantially vertical component.

12. The futon frame of claim 11 wherein said first supplemental support leg and said second supplemental support leg are pivotably mounted to said seat at points which are forward of said base forward cross member when the futon frame is in the closed position.

13. The futon frame of claim 11 wherein said first supplemental support leg and said second supplemental support leg are pivotably mounted to said seat at points which are aft of said base forward cross member when the futon frame is in the closed position.

14. The futon frame of claim 11 wherein said first supplemental support leg and said second supplemental support leg are pivotably mounted to said seat at points which are aft of said base forward cross member when the futon frame is in the closed position.

15. A futon frame for supporting a futon forming a chair or sofa when the futon frame is in a closed position and forming a bed when the futon frame is in an open position, the futon frame comprising:

a base having a first base end spaced apart from a second base end, said first base end having a first base end serpentine slot, and said second base end having a second base end serpentine slot;

a back having a first back side member and a second back side member;

a first back pivot pin, said first back pivot pin attaching to said first back side member and engaging said first base end serpentine slot;

a second back pivot pin, said second back pivot pin attaching to said second back side member and engaging said second base end serpentine slot;

a first back support pivotably engaging said first back side member about an axis B and pivotably engaging said base about an axis A;

a second back support pivotably engaging said second back side member about said axis B and pivotably engaging said base about said axis A;

a seat having a first seat side member and a second seat side member, said seat pivotably connecting to said back;

a first seat support pivotably connecting to said first seat side member and to said base;

a second seat support pivotably connecting to said second seat side member and to said base; and means for increasing the rigidity of said back and said seat when the futon frame is in the open position.

16. The futon frame of claim 15 wherein said means for increasing the rigidity of said back and said seat further comprises:

stabilizers connected to said base; and means for engaging said stabilizers with said back when the futon frame is in the open position.

17. The futon frame of claim 16 further wherein said means for engaging said stabilizers with said back comprises means for varying the separation between said axis B and said axis A.

18. The futon frame of claim 17 wherein:

said base further has a first base support pin and a second base support pin attached thereto and aligned with said axis A; and said back has a first back support pin and a second back support pin attached thereto and aligned with said axis B;

further wherein said means for varying the separation between said axis B and said axis A comprises:

a first back support cylindrical hole through said first back support which engages said first back support pin and a first back support slot through said first back support which engages said first base support pin; and a second back support cylindrical hole through said second back support which engages said second back support pin and a second back support slot through said second back support which engages said second base support pin.

19. The futon frame of claim 18 wherein said stabilizers are stabilizing rollers rotatably attached to said base.

20. The futon frame of claim 17 further comprising:

a first roller interposed between said first base end serpentine slot and said first back pivot pin; and a second roller interposed between said second base end serpentine slot and said second back pivot pin.

21. A futon frame for supporting a futon forming a chair or sofa when the futon frame is in a closed position and forming a bed when the futon frame is in an open position, the futon frame comprising:

a base having a first base end spaced apart from a second base end, said first base end having a first base end serpentine slot, said first base end serpentine slot having a first slot rear segment with a gradual descent of approximately 15°, a first slot middle segment with a steep rise of approximately 65°, and a first slot forward end, and said second base end having a second base end serpentine slot, said second base end serpentine slot having a second slot rear segment with a gradual descent of approximately 15°, a second slot middle segment with a steep rise of approximately 65°, and a second slot forward end;

a back having a first back side member and a second back side member;

a first back pivot pin, said first back pivot pin attaching to said first back side member and engaging said first base end serpentine slot;

a second back pivot pin, said second back pivot pin attaching to said second back side member and engaging said second base end serpentine slot;

a seat having a first seat side member and a second seat side member, said seat pivotably attaching to said back;

a first seat support pivotably attaching to said first seat side member and to said base; and a second seat support pivotably attaching to said second seat side member and to said base.

22. The futon frame of claim 21 further comprising:

a first roller interposed between said first base end serpentine slot and said first back pivot pin; and a second roller interposed between said second base end serpentine slot and said second back pivot pin.

* * * * *